US011286742B2

(12) United States Patent
Budde

(10) Patent No.: US 11,286,742 B2
(45) Date of Patent: Mar. 29, 2022

(54) SUB-SURFACE RELEASE PLUG SYSTEM

(71) Applicant: Weatherford Netherlands, B.V., Den Helder (NL)

(72) Inventor: Marcel Budde, Vlaardingen (NL)

(73) Assignee: Weatherford Netherlands, B.V., Dan Helder (NL)

( * ) Notice: Subject to any disclaimer, the term of this patent is extended or adjusted under 35 U.S.C. 154(b) by 345 days.

(21) Appl. No.: 16/455,475

(22) Filed: Jun. 27, 2019

(65) Prior Publication Data

US 2019/0376360 A1 Dec. 12, 2019

Related U.S. Application Data

(62) Division of application No. 15/452,975, filed on Mar. 8, 2017, now Pat. No. 10,378,304.

(51) Int. Cl.

| | |
|---|---|
| ***E21B 33/12*** | (2006.01) |
| ***E21B 33/16*** | (2006.01) |
| ***E21B 34/06*** | (2006.01) |
| ***E21B 34/10*** | (2006.01) |
| ***E21B 43/10*** | (2006.01) |

(52) U.S. Cl.

CPC ..... *E21B 33/12* (2013.01); *E21B 33/16* (2013.01); *E21B 34/063* (2013.01); *E21B 34/10* (2013.01); *E21B 43/10* (2013.01); *E21B 2200/06* (2020.05)

(58) Field of Classification Search

CPC ..... E21B 33/12; E21B 33/16; E21B 34/063; E21B 34/10; E21B 43/10; E21B 2034/007; E21B 2200/06

See application file for complete search history.

(56) References Cited

U.S. PATENT DOCUMENTS

| | | | |
|---|---|---|---|
| 3,228,473 | A | 1/1966 | Baker |
| 3,616,850 | A | 11/1971 | Scott |
| 3,730,267 | A | 5/1973 | Scott |
| 4,042,014 | A | 8/1977 | Scott |
| 5,553,667 | A | 9/1996 | Budde et al. |
| 5,787,979 | A | 8/1998 | Giroux et al. |
| 5,813,457 | A | 9/1998 | Giroux et al. |
| 6,009,944 | A | 1/2000 | Gudmestad |
| 6,056,053 | A | 5/2000 | Giroux et al. |
| 6,244,350 | B1 | 6/2001 | Gudmestad et al. |

(Continued)

FOREIGN PATENT DOCUMENTS

WO 94/27026 11/1994

OTHER PUBLICATIONS

European Office Action in related application GB1912308.2 dated Jun. 18, 2021.

(Continued)

*Primary Examiner* — Yong-Suk (Philip) Ro

(74) *Attorney, Agent, or Firm* — Patterson + Sheridan, LLP

(57) ABSTRACT

A subsurface release plug system includes a plug mandrel body and a plug. The plug mandrel body includes a bore, a flow port fluidly connected to the bore, and a sleeve adjustable from a first position to a second position. The sleeve prevents fluid flow through the flow port when in the first position and allows fluid flow through the flow port when in the second position. The plug is releasably connected to the plug mandrel body, wherein the plug is configured to be released from the plug mandrel body by fluid flowing through the flow port.

25 Claims, 21 Drawing Sheets

(56) References Cited

U.S. PATENT DOCUMENTS

| | | | | |
|---|---|---|---|---|
| 6,311,771 | B1 | 11/2001 | Gudmestad et al. | |
| 6,419,015 | B1 | 7/2002 | Budde et al. | |
| 6,571,880 | B1 | 6/2003 | Butterfield, Jr. | |
| 6,799,638 | B2 | 10/2004 | Butterfield, Jr. | |
| 6,802,372 | B2 | 10/2004 | Budde | |
| 6,848,511 | B1 * | 2/2005 | Jones | E21B 33/16 166/153 |
| 7,182,135 | B2 | 2/2007 | Szarka | |
| 8,327,937 | B2 | 12/2012 | Giem et al. | |
| 8,789,582 | B2 | 7/2014 | Rondeau et al. | |
| 10,378,304 | B2 | 8/2019 | Budde | |
| 2003/0164237 | A1 | 9/2003 | Butterfield | |
| 2013/0012410 | A1 | 1/2013 | Zou et al. | |
| 2013/0112410 | A1 | 5/2013 | Szarka et al. | |
| 2015/0101801 | A1 | 4/2015 | Budde | |

OTHER PUBLICATIONS

PCT International Search Report and Written Opinion dated Jul. 11, 2018, for International Application No. PCT/US2018/020373.
PCT International Preliminary Report on Patentability dated Sep. 10, 2019 for International Application No. PCT/US2018/020373.
United Kingdom Search Report in related application GB2114300.3 dated Dec. 16, 2021.

* cited by examiner

SUB-SURFACE RELEASE PLUG SYSTEM

CROSS-REFERENCE TO RELATED APPLICATIONS

This Application is a divisional of U.S. patent application Ser. No. 15/452,975 filed on Mar. 8, 2017. The aforementioned application is herein incorporated by reference in its entirety.

BACKGROUND OF THE DISCLOSURE

Field of the Disclosure

Embodiments of the present disclosure generally relate to a sub-surface release plug system and a method of using a sub-surface release plug system.

Description of the Related Art

A wellbore is formed by using a drill bit on a drill string to drill through a geological formation. After drilling through the formation to a predetermined depth, the drill string and drill bit are removed, and the wellbore is lined with a string of casing. The space between the outer diameter of the casing and the wellbore is referred to as an annulus. In order to prevent the casing from moving within the wellbore, the annulus is filled with cement slurry using a cementing operation. In addition to preventing the casing from moving within the wellbore, the cemented annulus provides for a stronger wellbore for facilitation of hydrocarbon production.

As the casing is being lowered downstream, the casing is typically filled with a fluid (e.g., drilling mud) and the fluid is maintained at a predetermined pressure. The fluid within the casing ensures that the casing does not collapse within the wellbore. A bottom end of the casing usually includes a float assembly, such as a float collar or a float shoe. The float assembly includes one or more unidirectional check valves that allow fluid to pass from the casing out to the annulus, but prevents fluid from entering from the annulus into the casing. An upper end of the float assembly may also include a receptacle for receiving a device, such as a cement plug.

During a cementing operation, the cement is preferably isolated or separated from any other fluid within the casing. When fluids (e.g., drilling mud) mix with cement, it can cause the cement to fail to set properly. Accordingly, a first cement plug is usually sent down in front of the cement slurry during a cementing operation. The first cement plug is released from a plug mandrel positioned within the casing lowered downstream. The first cement plug is released from the plug mandrel via a first release member (e.g., a dart or ball). The first release member is pumped downstream through the plug mandrel and received within a bore of the first cement plug. After the first release member sealingly engages the first cement plug, an increase in hydrostatic pressure within the plug mandrel releases the first cement plug. The first cement plug and the first release member engaged with the first cement plug are pumped downstream within the casing. The first cement plug includes one or more fins around its circumference which acts to separate the drilling fluid below the first plug from the cement slurry above the first cement plug. The fins also wipe clean the inner walls of the casing as the first plug descends downstream within the casing. Because the first cement plug provides both a separation and cleaning function, the outer diameter of the first cement plug is approximately equal to the inner diameter of the casing.

The first release member includes a rupture membrane (e.g., a rupture disk or rupture sleeve). The rupture membrane prevents the fluid below the first cement plug from comingling with the cement slurry above the first cement plug. As the first cement plug descends downstream within the casing, fluid in the casing is pushed downstream and out into the annulus through the float assembly. The check valve within the float assembly prevents the drilling fluid from moving back into the casing.

Once the first cement plug reaches the float assembly, hydrostatic pressure builds on the upper side of the rupture membrane. Once a rupture pressure is reached within the casing, the rupture membrane of the first release member ruptures and the cement flows through the bore of the first cement plug, through the float assembly, and into the annulus. The check valve within the float assembly prevents the cement from flowing back into the casing.

A second cement plug is usually sent downstream through the casing behind the cement slurry. Like the first cement plug, the second cement plug is released from the plug mandrel. The second cement plug is released via a second release member (e.g., a dart or ball). The second release member is pumped downstream through the plug mandrel and received within a bore of the second cement plug. After the second release member sealingly engages the second cement plug, an increase in hydrostatic pressure within the plug mandrel releases the second cement plug. The second cement plug and the second release member engaged with the second cement plug are then pumped downstream within the casing. Like the first cement plug, the second cement plug may include one or more fins around its circumference. The one or more fins of the second cement plug separate the cement slurry below the second cement plug from the drilling fluid above the second cement plug. The fins also wipe clean the sidewalls of the casing as the second cement plug descends downstream through the casing. The second release member generally does not include a rupture membrane like the first release member. As the second cement plug is pumped downstream through the casing, any remaining cement slurry within the casing is squeezed out of the float assembly into the annulus until the second cement plug reaches the first cement plug.

In some embodiments, the first cement plug and second cement plug are locked together. Because the first release member may protrude upwardly from the first cement plug, the second cement plug must be designed to accommodate for this protrusion. After the second cement plug lands onto the first cement plug, the second cement plug seals the bore of first cement plug. This prevents the well from being circulated after the second cement plug engages the first cement plug.

Therefore, there is a need for an improved sub-surface release plug system capable of having more than two cement plugs. Moreover, there is a need for an improved sub-surface release plug system in which the release members pumped downstream through the plug mandrel are recoverable after the cement plugs are released from the plug mandrel.

SUMMARY

A first embodiment of the preset disclosure relates to a subsurface release plug system includes a plug mandrel body and a plug. The plug mandrel body includes a bore, a bore, a flow port fluidly connected to the bore, and a sleeve adjustable from a first position to a second position. The sleeve prevents fluid flow through the flow port when in the first position and allows fluid flow through the flow port when in the second position. The plug is releasably connected to the plug mandrel body, wherein the plug is configured to be released from the plug mandrel body by fluid flowing through the flow port.

Another embodiment of the present disclosure relates to a plug including an internal surface bounding a bore and a receptacle collar. The bore extends through the plug. The receptacle collar is located within the bore. The receptacle collar includes a protrusion extending into the bore. The protrusion is configured to be slidably located within a channel of an insert.

Another embodiment of the present disclosure relates to a plug mandrel subassembly including a plug mandrel body and a detachable insert releasably connected to the plug mandrel body. The plug mandrel body includes a bore, a flow port fluidly connected to the bore, and an adjustable sleeve positionable to prevent fluid from flowing through the flow port. The detachable insert releasably connects to the plug mandrel body.

Another embodiment of the present disclosure relates to a method of operating a sub-surface release plug system including receiving a release member within a sleeve of a plug mandrel body, opening a flow port in the plug mandrel body, and moving a plug along the plug mandrel body.

Another embodiment of the present disclosure relates to a method of operating a sub-surface release plug system including moving a plug along a plug mandrel body, connecting the plug to an insert attached to the plug mandrel body, and detaching the insert from the plug mandrel body to release the plug and the insert downhole.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

The present disclosure generally relates to a subsurface release (SSR) plug system configured to be positioned and operated within a wellbore. More specifically, the SSR plug system is configured to be positioned within a string of casing lowered into the wellbore and ready to be cemented in an annulus.

Overview of SSR Plug System

Figure 1:
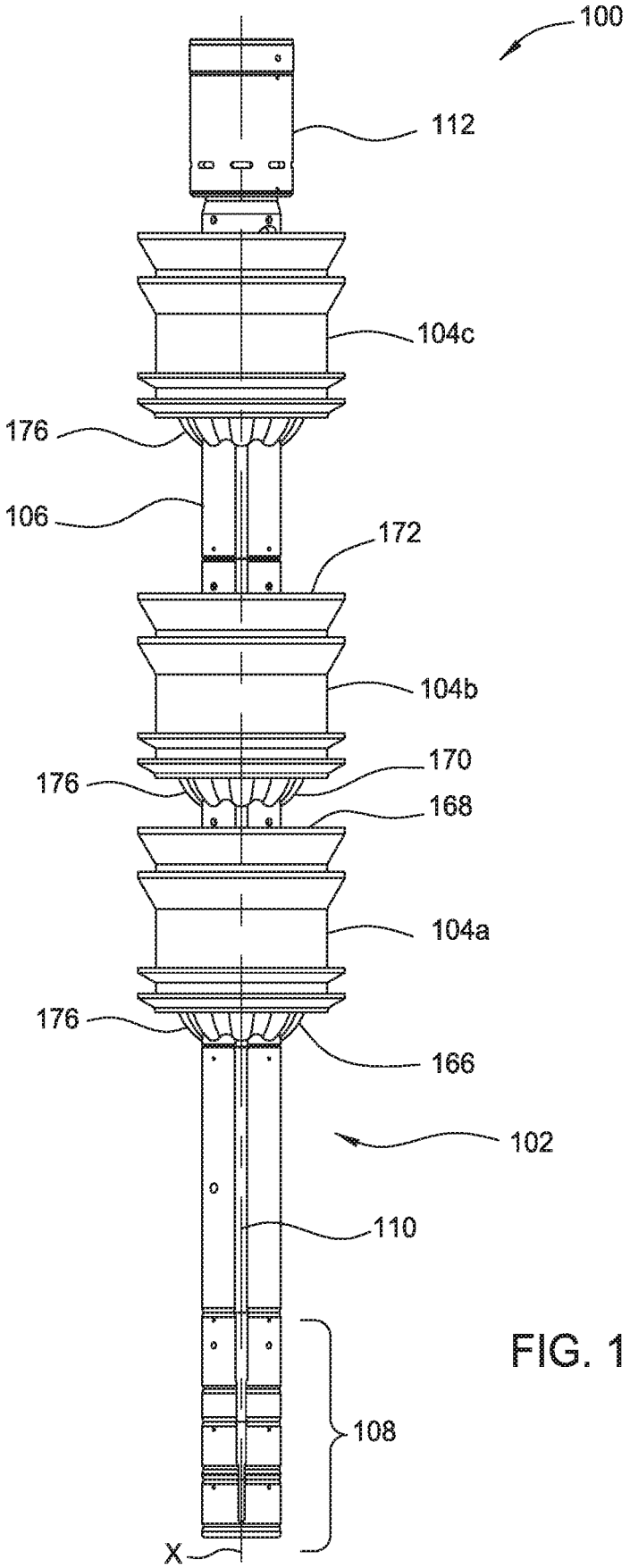
FIG. 1 illustrates a SSR plug system in accordance with the present disclosure, the SSR plug system including a plug mandrel subassembly and a plurality of plugs.
Figure 2:
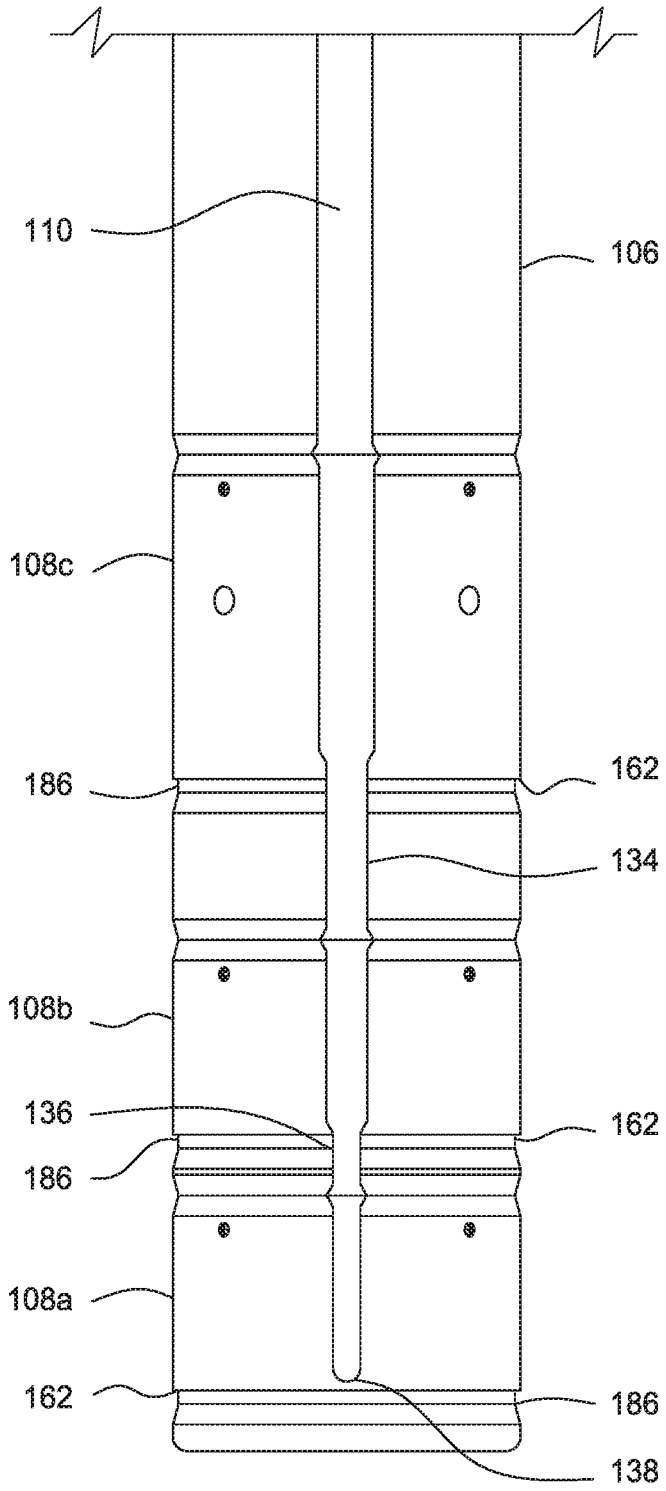
FIG. 2 illustrates a magnified view of the SSR plug system shown in FIG. 1, the magnified view focusing on detachable inserts of the plug mandrel subassembly.
Figure 5:
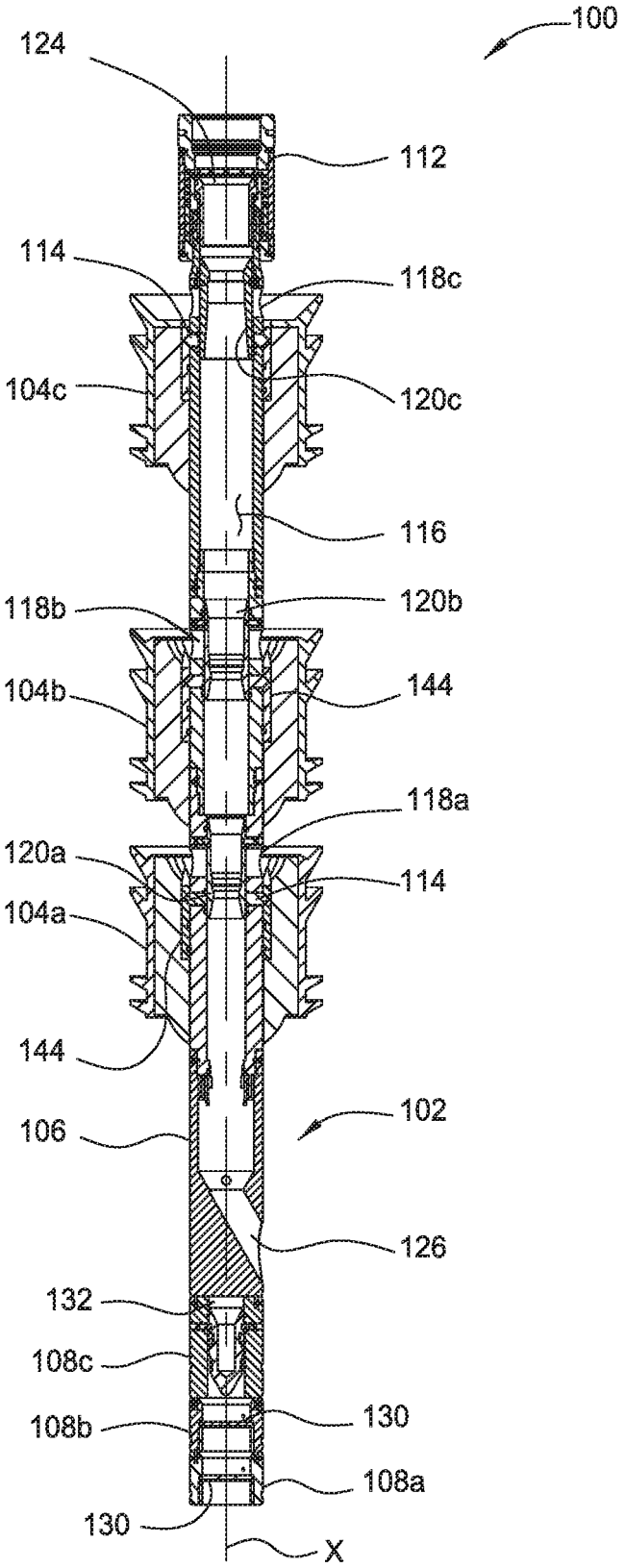
FIG. 5 illustrates a cross-sectional view of the SSR plug system shown in FIG. 1.
Figure 6:
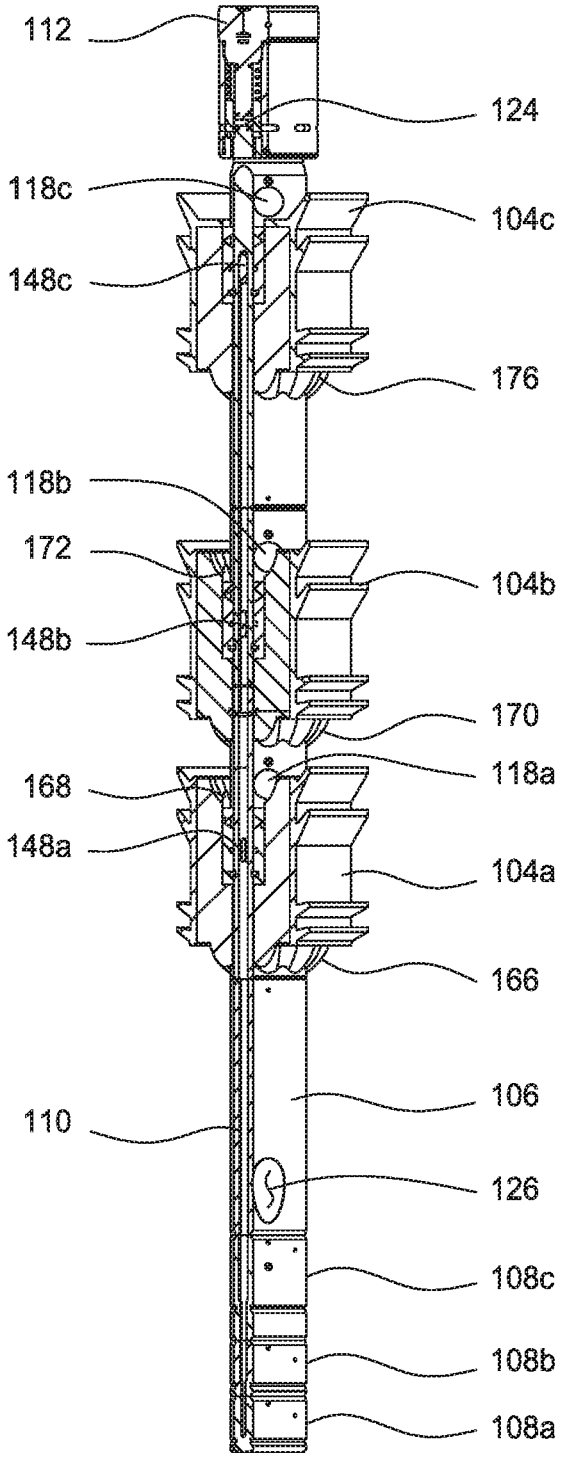
FIG. 6 illustrates a rotated cross-sectional view of the SSR plug system shown in FIG. 1.

FIG. 1 shows an SSR plug system 100 including a plug mandrel subassembly 102 and a plurality of plugs 104. The plug mandrel subassembly 102 includes a plug mandrel body 106, a plurality of detachable inserts 108, a channel 110, a top sub 112, and a plurality of retractable spring components 114 (which can be seen in FIG. 5). The channel 110 extends longitudinally along the plug mandrel body 106 and the plurality of detachable inserts 108. As shown in the cross-sectional views of FIGS. 5 and 6, the plug mandrel body 106 includes a bore 116, a plurality of flow port pairs 118, and a plurality of sleeves 120. Each flow port pair 118 is fluidly connected to the bore 116. The top sub 112 is configured to attach the SSR plug system 100 to a tubular string 122.

The bore 116 of the plug mandrel body 106 includes an inlet port 124 and an outlet port 126. The inlet port 124 is upstream of the plurality of flow port pairs 118. The outlet port 126 is downstream of the plurality of flow port pairs 118. The inlet port 124 is positioned along a longitudinal axis X of the plug mandrel body 106, the longitudinal axis X lying within a longitudinal plane that is perpendicular to the page of FIGS. 1 and 5. The plurality of flow port pairs 118 and the outlet port 126 are spaced from the longitudinal axis X. One flow port of each flow port pair 118 is positioned on a first side of the longitudinal plane P, and the other flow port pair of each flow port pair is positioned on an opposite side of the longitudinal plane P. It is to be understood, however, that the SSR plug system 100 could be altered such that the plug mandrel body 106 only includes a plurality of individual flow ports rather than a plurality of flow port pairs 118 (as shown, for example, in FIG. 7).

Spacing the outlet port 126 from the longitudinal axis X enables the plurality of detachable inserts 108 to be positioned downstream of the plug mandrel body 106. The outlet port 126 is sized to enable fluid flowing through the bore 116 of the plug mandrel body 106 to exit the outlet port with minimal flow restriction. Depending upon the fluid flow, the bore 116 of the plug mandrel body 106 could include additional outlet ports to ensure there is not a flow restriction as fluid exits the bore.

In the embodiments shown in FIGS. 1-21, the number of detachable inserts 108 of the plug mandrel subassembly 102 corresponds to the number of plugs 104 releasably connected to the plug mandrel body 106. Similarly, the number of flow port pairs 118, the number of sleeves 120, and the number of retractable spring components 114 corresponds to the number of plugs 104 releasably connected to the plug mandrel body 106. It is to be understood, however, that the SSR plug system 100 could include fewer or additional plugs, detachable inserts, flow port pairs, sleeves, and retractable spring components than that shown in the figures. It is to be further understood that the number of plugs, detachable inserts, flow port pairs, sleeves, and retractable spring components need not correspond with each other in some embodiments of an SSR plug system in accordance with the present description.

Each sleeve 120 is adjustable from a first position to a second position. When in the first position, each sleeve 120 prevents fluid flow through the adjacent, corresponding flow port pair 118. When in the second position, each sleeve 120 allows fluid flow through the adjacent, corresponding flow port pair 118. The sleeves 120 are configured such that each sleeve can be individually adjusted from the first position to the second position. Accordingly, in the SSR plug system 100, the lower sleeve 120*a* may be adjusted from the first position to the second position permitting fluid flow through lower flow port pair 118*a* while the middle sleeve 120*b* and/or the upper sleeve 120*c* remain in the first position preventing fluid flow through the middle and/or upper flow ports 118*b*, 118*c* respectively. In this manner, each sleeve 120 is individually and selectively adjustable between the first position and the second position.

Figure 3:
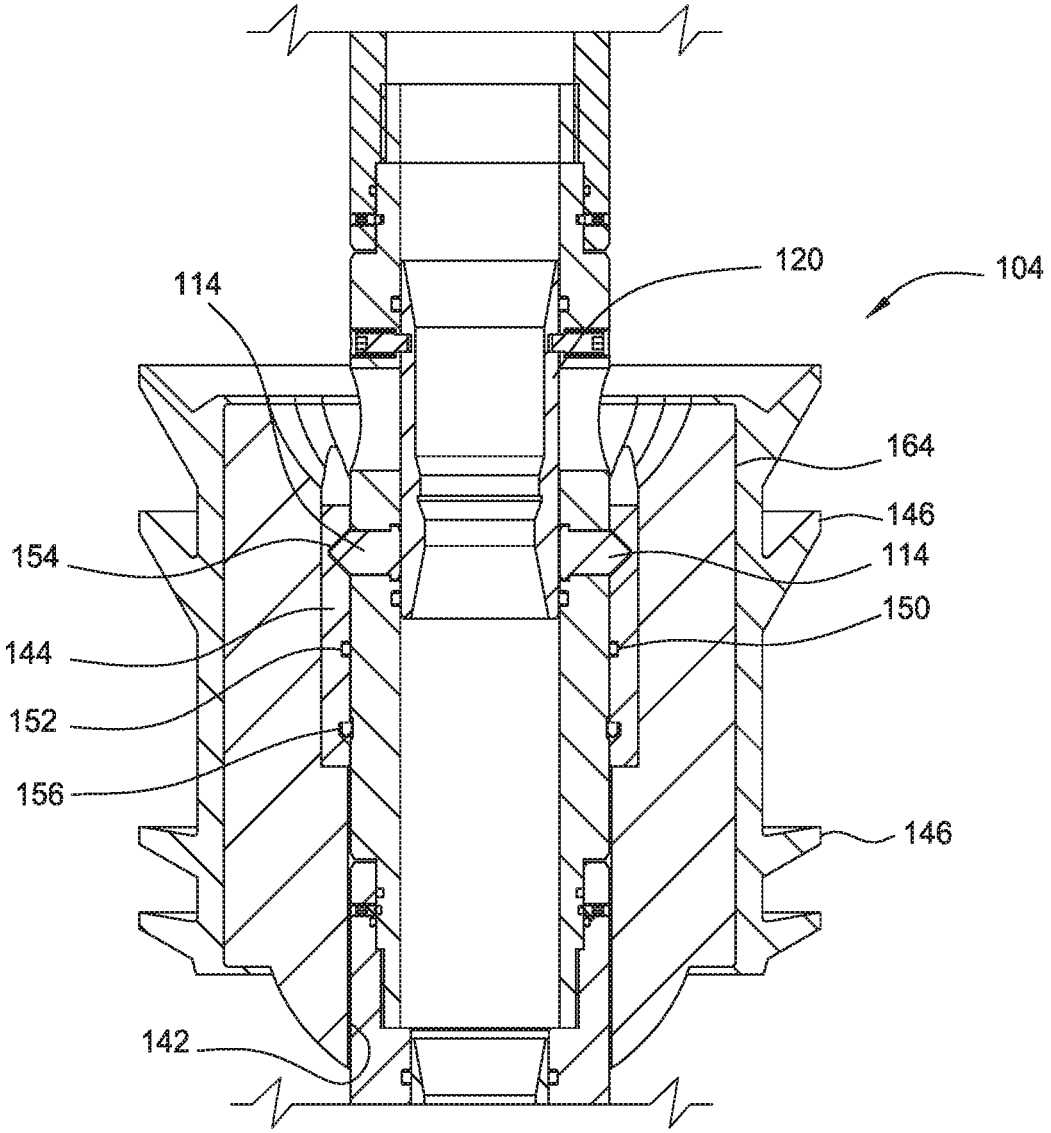
FIG. 3 illustrates a magnified cross-sectional view of one of the plurality of plugs shown in FIG. 1.
Figure 4:
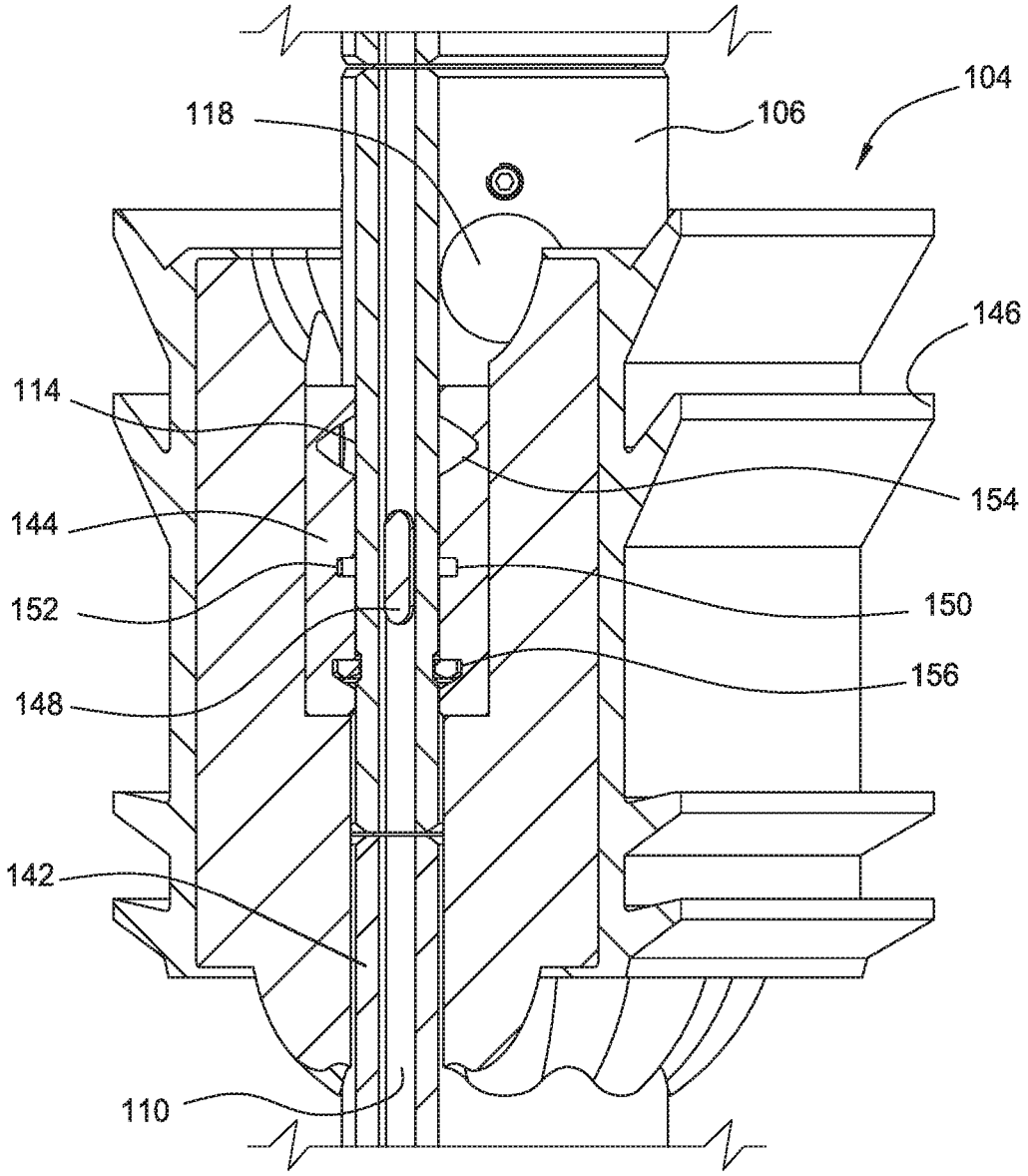
FIG. 4 illustrates a magnified rotated cross-sectional view of one of the plurality of plugs shown in FIG. 1.

In the embodiment shown in FIGS. 1 and 3, each sleeve 120 is a release member receiver configured to adjust from the first position to the second position upon receipt of a release member 128 flowing downstream within the bore 116 of the plug mandrel body 106. Each sleeve 120 is shearingly attached to an interior surface of the plug mandrel body 106 defining the bore 116. Each sleeve 120 may be shearingly attached to the interior surface utilizing at least one shear pin. In addition, each sleeve 120 is dimensioned differently, such that each sleeve is capable of receiving a different sized release member 128. For example, the upper sleeve 120*c* has the largest internal dimension, the lower sleeve 120*a* has the smallest internal dimension, and the middle sleeve 120*b* has an internal dimension greater than the lower sleeve but smaller than the upper sleeve. In this manner, the SSR plug system 100 can be operated such that a first release member 128*a* flowing downstream within the bore 116 can pass through the upper sleeve 120*c* and the middle sleeve 120*b* before being subsequently received by the lower sleeve 120*a*. Upon receipt of the first release member 128*a* within the lower sleeve 120*a*, the bore 116 of the plug mandrel body 106 is fluidly sealed to thereby enable the hydrostatic pressure within the plug mandrel body to be increased, as discussed in more detail below. The SSR plug system 100 can then be operated such that a second release member 128*b* flowing downstream within the bore 116 can pass through the upper sleeve 120*c* before being subsequently received by the middle sleeve 120*b*, and a third release member 128*c* can be subsequently pumped downstream within the bore 116 to become received by the upper sleeve 120*c*.

In the embodiment shown in FIGS. 1-19, each release member 128 pumped downstream within the bore 116 is a dart, and each sleeve 120 is a dart receiver. A person of ordinary skill in the art will understood, however, that each release member 128 could be, for example, a ball or other plug and each sleeve 120 could be configured to receive the corresponding release member.

Each detachable insert 108 is configured to sealingly connect with one of the plugs 104. The detachable inserts 108 are positioned downstream of the outlet port 126. The upper detachable insert 108*c* is releasably connected to the plug mandrel body 106 by at least one shear pin. The middle detachable insert 108*b* is releasably connected to the upper detachable insert 108*c* by at least one shear pin. The lower detachable insert 108*a* is releasably connected to the middle detachable insert 108*b* by at least one shear pin. Because of this configuration and the operation of the SSR plug system 100 discussed in more detail below, the shear pin corresponding to the upper detachable insert 108*c* must have the highest shear strength. This ensures that the upper detachable insert 108*c* is not prematurely detached from plug mandrel body 106 when attempting to release the middle or lower detachable inserts 108*b*, 108*a*. The shear pin corresponding to the lower detachable insert 108*a* must have the lowest shear strength. The shear pin corresponding to the middle detachable insert 108*b* must have a shear strength between the shear strength of the shear pin corresponding to the lower detachable insert 108*a* and the shear strength of the shear pin corresponding to the upper detachable insert 108*c*. As a nonlimiting example, the shear pin corresponding to the upper detachable insert 108*c* may have a shear strength of about 2,000 psi, the shear pin corresponding to the middle detachable insert 108*b* may have a shear strength of about 1,000 psi, and the shear pin corresponding to the lower detachable insert 108*a* may have a shear strength of about 500 psi.

In one embodiment, the lower detachable insert 108*a* may include a rupture membrane 130. Similarly, the middle detachable insert 108*b* may include a rupture membrane 130. Each rupture membrane 130 is configured to rupture after the rupture membrane is exposed to hydrostatic pressure exceeding the shear strength of the rupture membrane.

It is to be understood that the shear strength of the rupture membrane for the lower detachable insert 108*a* may be the same as the shear strength of the rupture member for the middle detachable insert 108*b*. Alternatively, it is to be understood that the shear strength of the rupture membrane for the lower detachable insert 108*a* may differ from the shear strength of the rupture membrane for the middle detachable insert 108*b*.

In one embodiment, the upper detachable insert 108*c* may include a sealing member 132. The sealing member 132 may be held in place within the insert 108*c* by, for example, a shear pin. The sealing member 132 is configured to be released from the upper detachable insert 108*c* when exposed to hydrostatic pressure exceeding the shear strength of the shear pin. The sealing member 132 is substantially identical to the sealing member 70A described in detail in U.S. Publication No. 2015/0101801, which is hereby incorporated by reference in its entirety. It is to be understood, however, that the upper detachable insert 108*c* may include a rupture membrane 130 in place of the sealing member 132.

As seen in FIGS. 1 and 3, the channel 110 is substantially straight and extends longitudinally along the plug mandrel body 106 and the plurality of detachable inserts 108. Accordingly, the plug mandrel body 106 includes a first portion of the channel 110, the upper detachable insert 108*c* includes a second portion of the channel 110, the middle detachable insert 108*b* includes a third portion of the channel 110, and the lower detachable insert 108*c* includes a fourth portion of the channel 110. The second portion of the channel 110 corresponding to the upper detachable insert 108*c* includes a first channel stop 134. The third portion of the channel 110 corresponding to the middle detachable insert 108*b* includes a second channel stop 136. The fourth portion of the channel 110 corresponding to the lower detachable insert 108*c* includes a third channel stop 138. The first channel stop 134 may include a necked-down region having a first minimum width, the second channel stop 136 may include a second necked-down region having a second minimum width, and the third channel stop 138 may include a shoulder located at the lower end of the channel 110. The first minimum width of the first channel stop 134 may be greater than the second minimum width of the second channel stop 136 because of the operation of the SSR plug system 100 discussed in more detail below.

Each plug 104 includes an internal surface bounding a bore 142, a receptacle collar 144, and a plurality of fins 146. As best seen in FIG. 3, the bore 142 of each plug 104 extends through the entirety of the plug. The receptacle collar 144 of each plug 104 includes a protrusion 148, a seal channel 150, a seal 152 positioned within the seal channel, a recessed portion 154, and a lock collar 156. The protrusion 148 of each plug 104 extends radially inward. The protrusion 148 of each plug 104 is sized differently. For example, the protrusion 148*c* of the upper plug 104*c* has a first maximum width, the protrusion 148*b* of the middle plug 104*b* has a second maximum width, and the protrusion 148*a* of lower plug 104*a* has a third maximum width. The first maximum width is greater than the second and third maximum widths, and the second maximum width is greater than the third maximum width.

The seal channel 150 of each plug 104 is c-shaped because of the positioning of the protrusion 148. Accordingly, each seal channel 150 has a first end 158 and a second end 160, the first end being spaced from the second end by the protrusion 148. The seal 152 within each seal channel 150 ensures a fluid-tight seal between the plug 104 and the corresponding detachable insert 108 after the insert is connected to the plug.

Each lock collar 156 is configured to bear against a shoulder 162 of the corresponding insert 108 after the insert is connected to the plug 104. Collectively, engagement of the lock collar 156 with the shoulder 162 of the corresponding insert 108 and engagement of the corresponding channel stop with the protrusion 148 of the plug 104 connects the insert to the plug. Additionally, this arrangement prevents dislodgement of the insert 108 from the bore 142 of the plug 104 after the components become connected with each other.

Each plug 104 is releasably connected to the plug mandrel body 106 via one of the retractable spring components 114 of the plug mandrel subassembly 102. The protrusion 148 of each plug 104 is located within the channel 110. As best seen in FIG. 3, each retractable spring component 114 is biased radially outward from the plug mandrel body 106. Additionally, each retractable spring component 114 includes an angled profile 164, which can be best seen in FIG. 3, configured to engage the recessed portion 154 of the receptacle collar 144 of one of the plugs 104. As discussed in more detail below, each plug 104 is configured to be released from the plug mandrel body 106 after fluid from within the bore 116 of the plug mandrel body is permitted to flow through the adjacent flow port pair 118.

The lower plug 104*a* has a protruding end 166 and a recessed end 168. The recessed end 168 has an inverted profile matching the protruding end 166 such that the protruding end could be received within the recessed end. The middle plug 104*b* also has a protruding end 170 and a recessed end 172, the protruding end and the recessed end of the middle plug being substantially similar to the protruding end and the recessed end of the lower plug 104*a*. In this manner, the protruding end 170 of the middle plug 104*b* is received within the recessed end 168 of the lower plug 104*a*, such that the middle plug and lower plug are able to mate with each after having been released from the plug mandrel body 106 and urged downstream within a casing string 174. The upper plug 104*c* may also have a protruding end 176 substantially similar to the protruding end 170 of the middle plug 104*b*, thereby enabling the upper plug 104*c* to mate with middle plug 104*b* after having been released from the plug mandrel body 106 and flowing downstream within the casing string 174. The upper plug 104*c* may not have a recessed end because the upper plug does not have to receive any additional plugs. It is to be understood, however, that upper plug 104*c* could have a recessed end similar to the recessed ends of the middle plug 104*b* and the lower plug 104*a*.

Operation of SSR Plug System

In operation, the SSR plug system 100 enables each plug 104 to be released individually and sequentially from the plug mandrel body 106. For example, the SSR plug system 100 enables lower plug 104*a* to be released from the plug mandrel body 106 first, followed by the release of the middle plug 104*b* from the plug mandrel body, followed by the release of the upper plug 104*c* from the plug mandrel body. FIGS. 7-19 show the operation of the SSR plug system 100.

Figure 7:
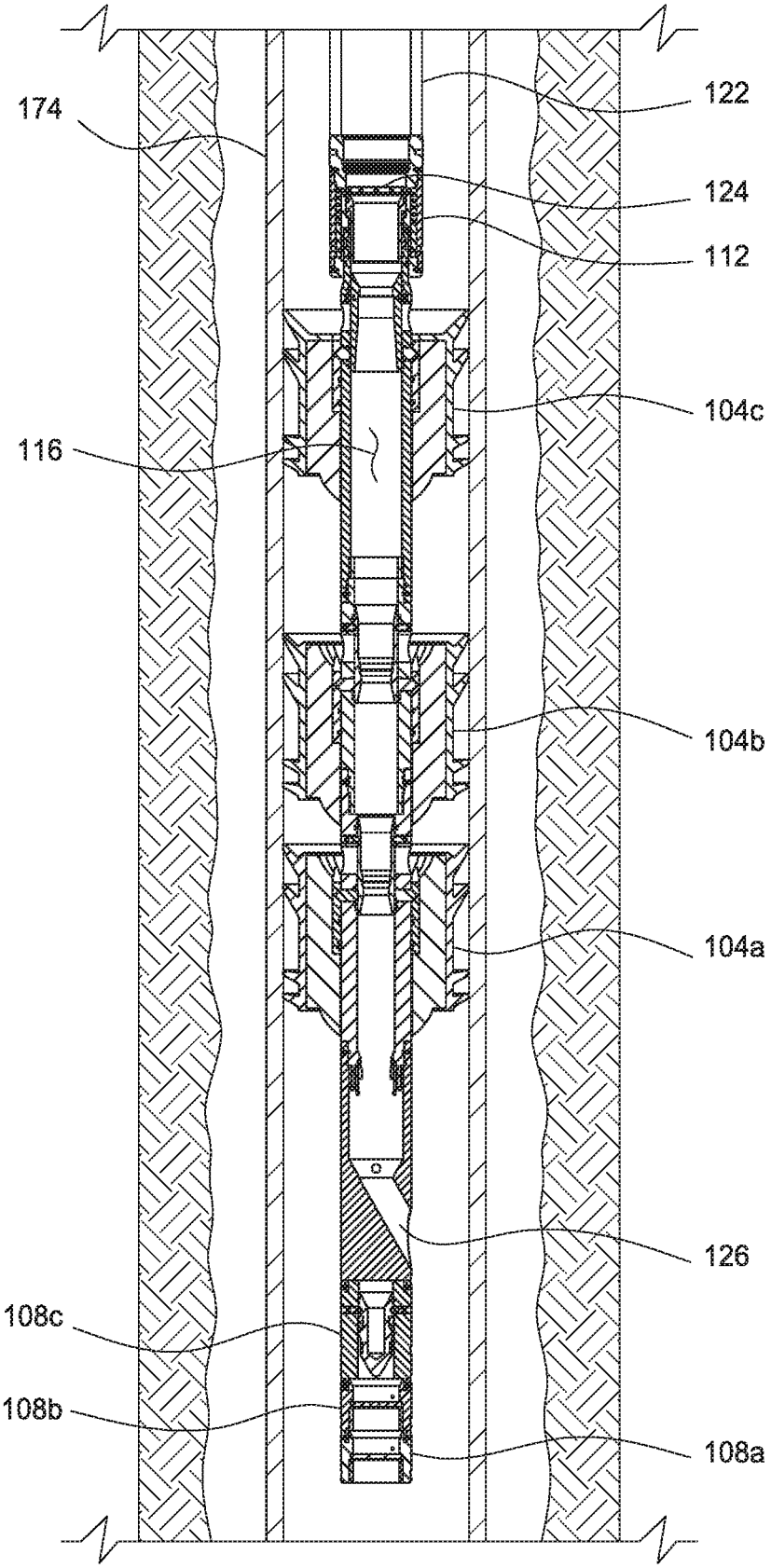
FIG. 7 illustrates the SSR plug system shown in FIG. 1 lowered into a casing string, the SSR plug system being in a pre-launch position.
Figure 8:
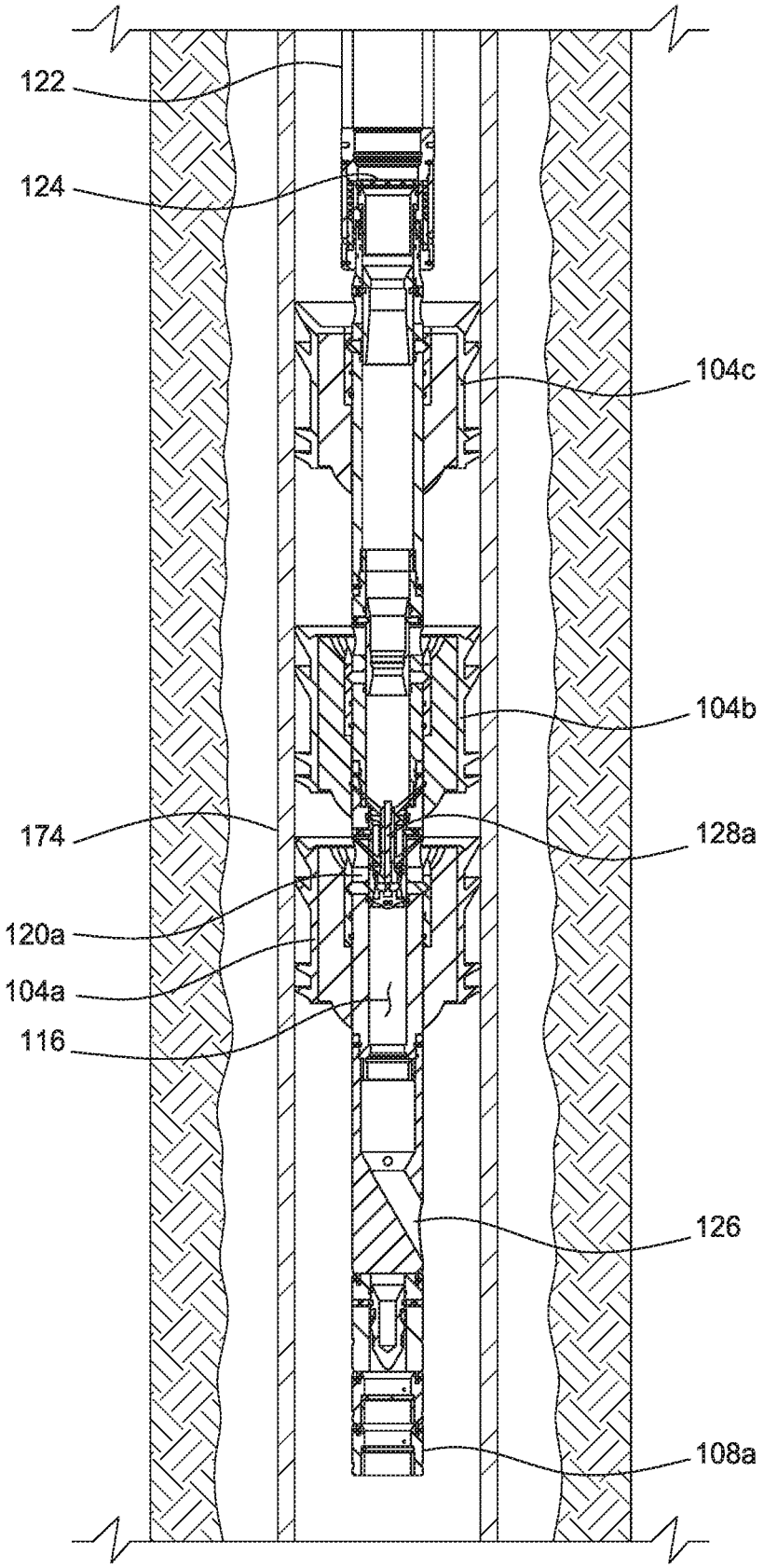
FIG. 8 illustrates a cross-sectional view of the SSR plug system, with a first release member having been received within a lower sleeve of the plug mandrel subassembly.
Figure 9:
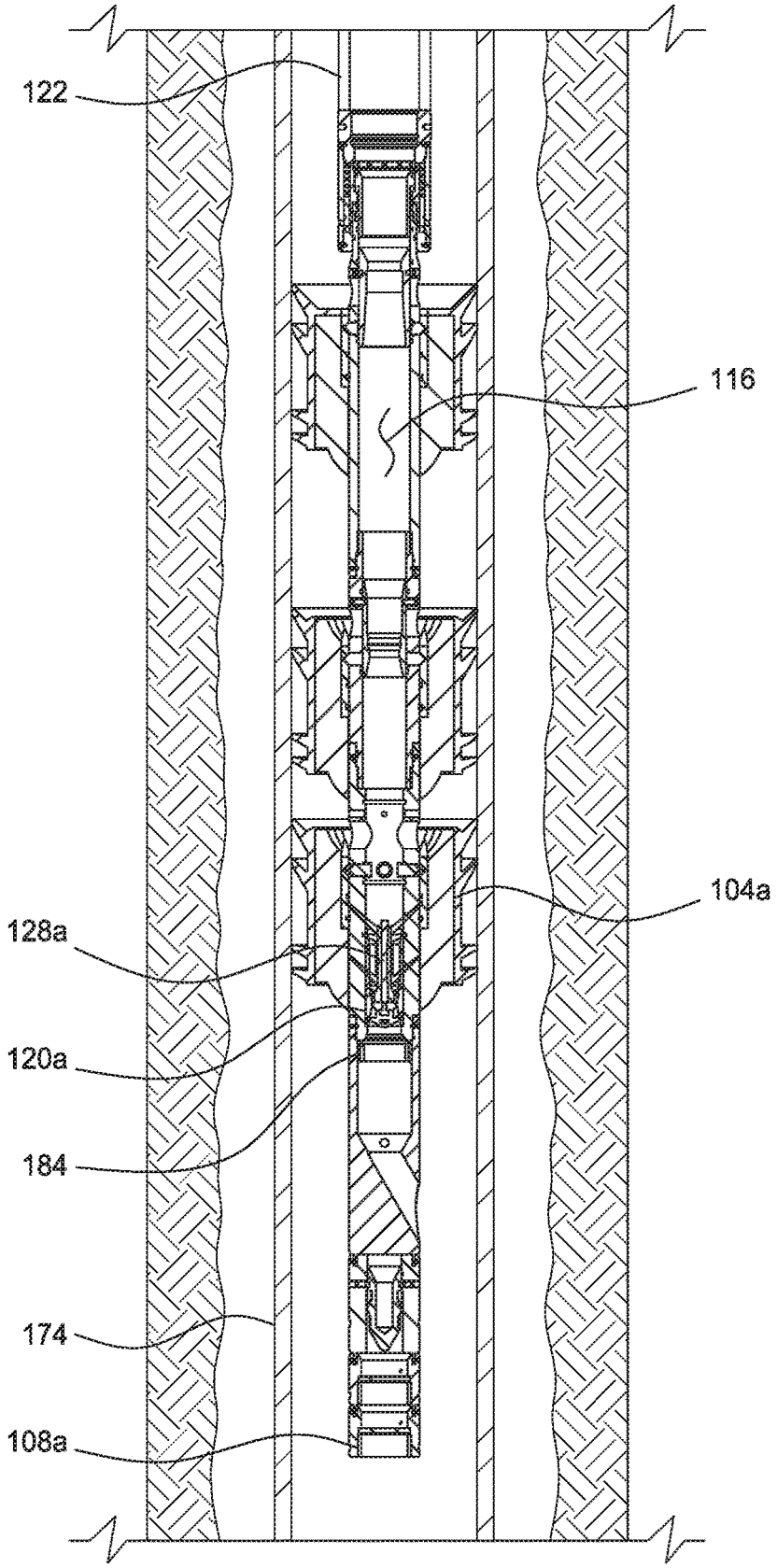
FIG. 9 illustrates a cross-sectional view of the SSR plug system, with the lower sleeve being in the second position to thereby allow fluid flow through a lower flow port pair.
Figure 10:
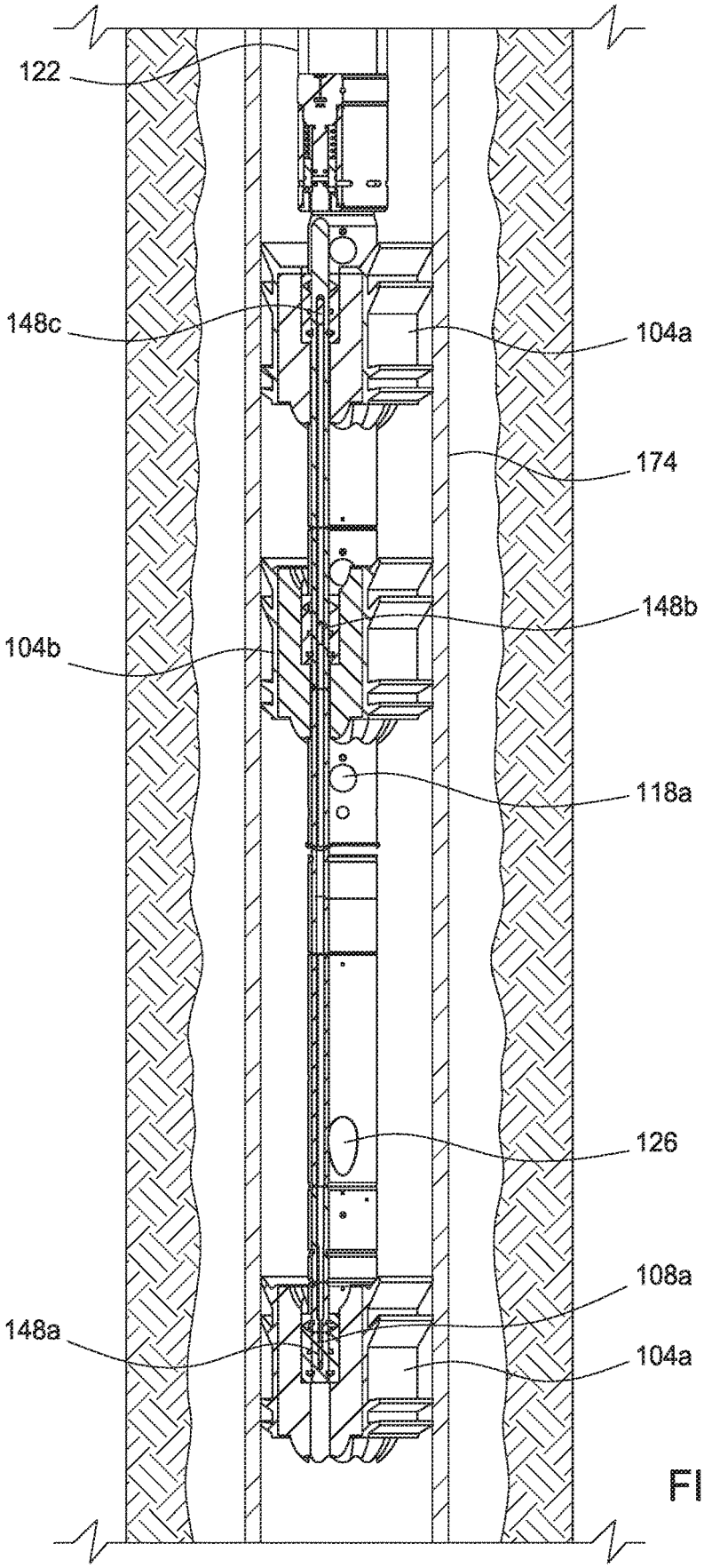
FIG. 10 illustrates a rotated cross-sectional view of the SSR plug system, with the lower plug having been displaced downwardly along the plug mandrel body and being connected to the lower detachable insert.
Figure 11:
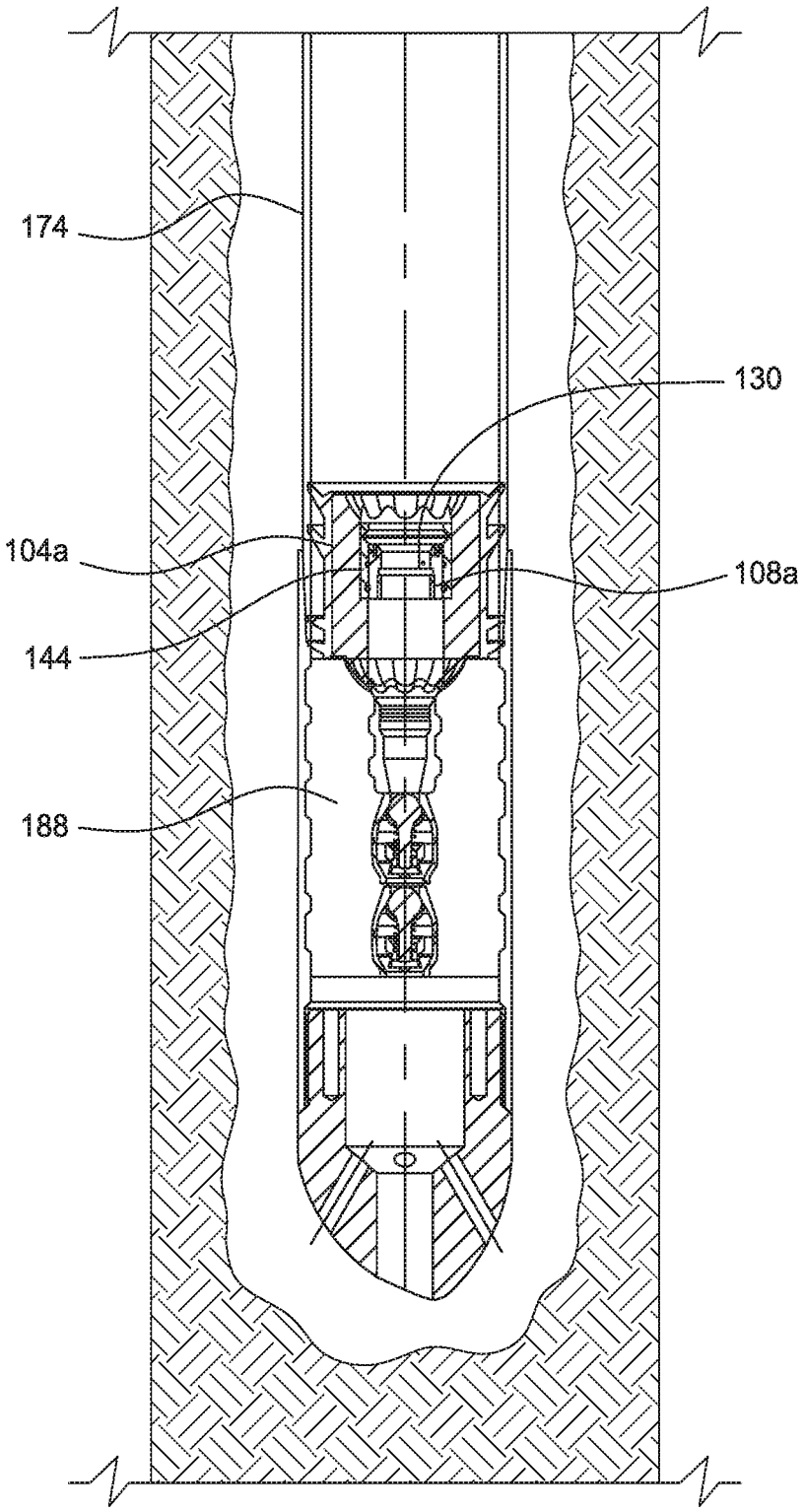
FIG. 11 illustrates a cross-sectional view of the casing string, with the lower plug and the lower detachable insert having been sheared from the plug mandrel body and being landed on a float collar.
Figure 12:
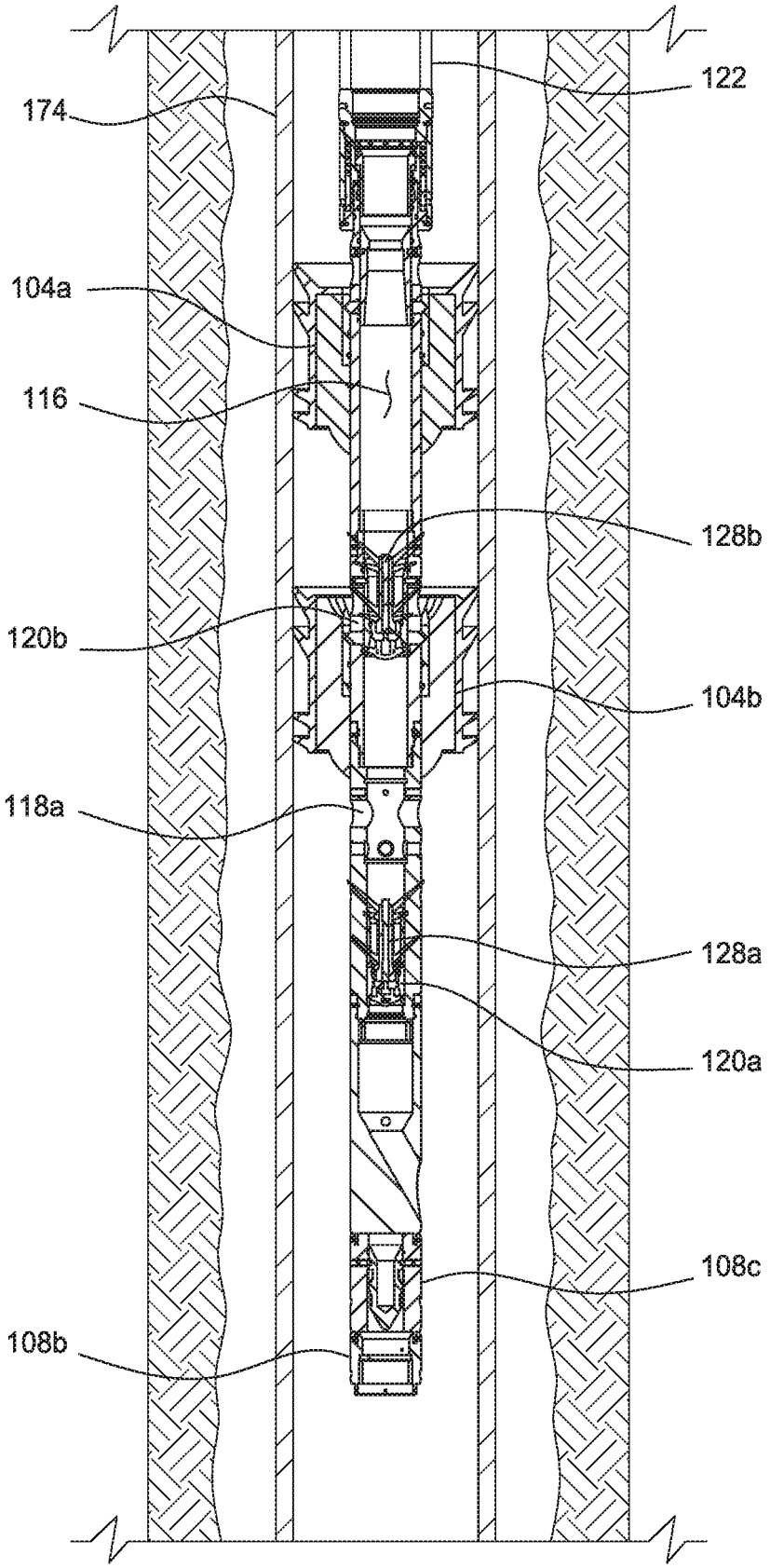
FIG. 12 illustrates a cross-sectional view of the SSR plug system, with a second release member having been received within a middle sleeve of the plug mandrel subassembly.
Figure 13:
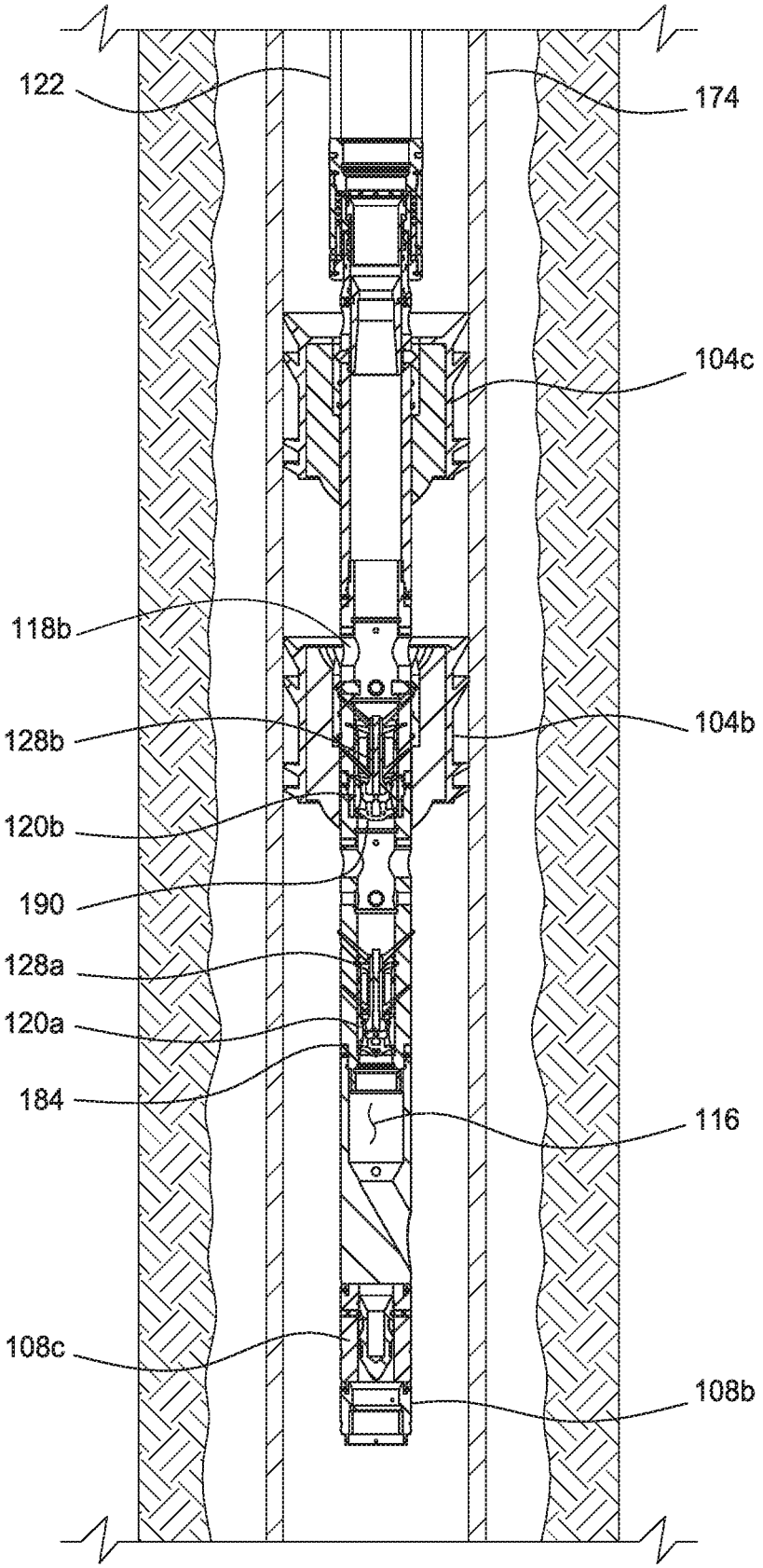
FIG. 13 illustrates a cross-sectional view of the SSR plug system, with the middle sleeve being in the second position to thereby allow fluid flow through a middle flow port pair.
Figure 14:
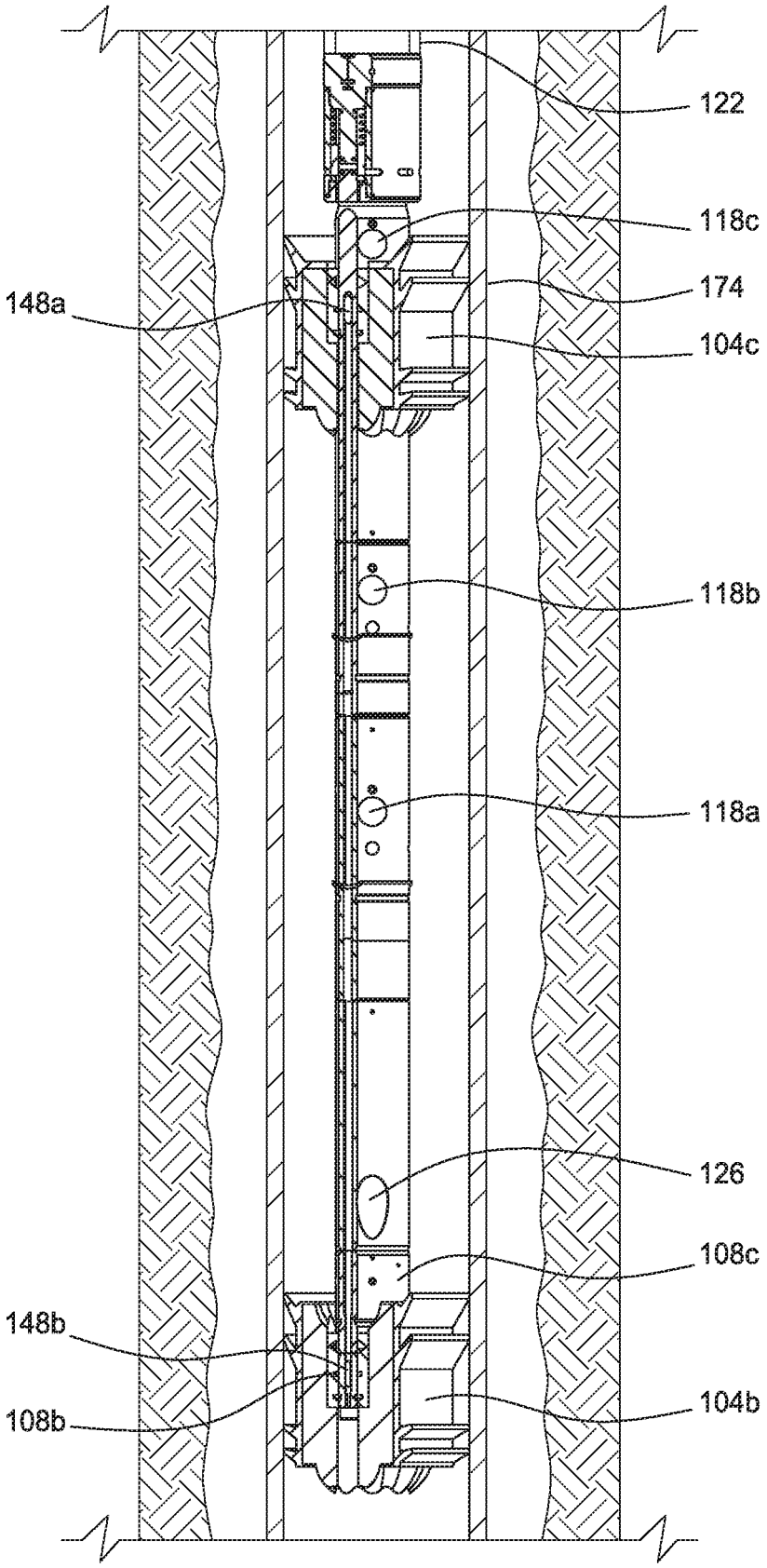
FIG. 14 illustrates a rotated cross-sectional view of the SSR plug system, with the middle plug having been displaced downwardly along the plug mandrel body and being connected to the middle detachable insert.
Figure 15:
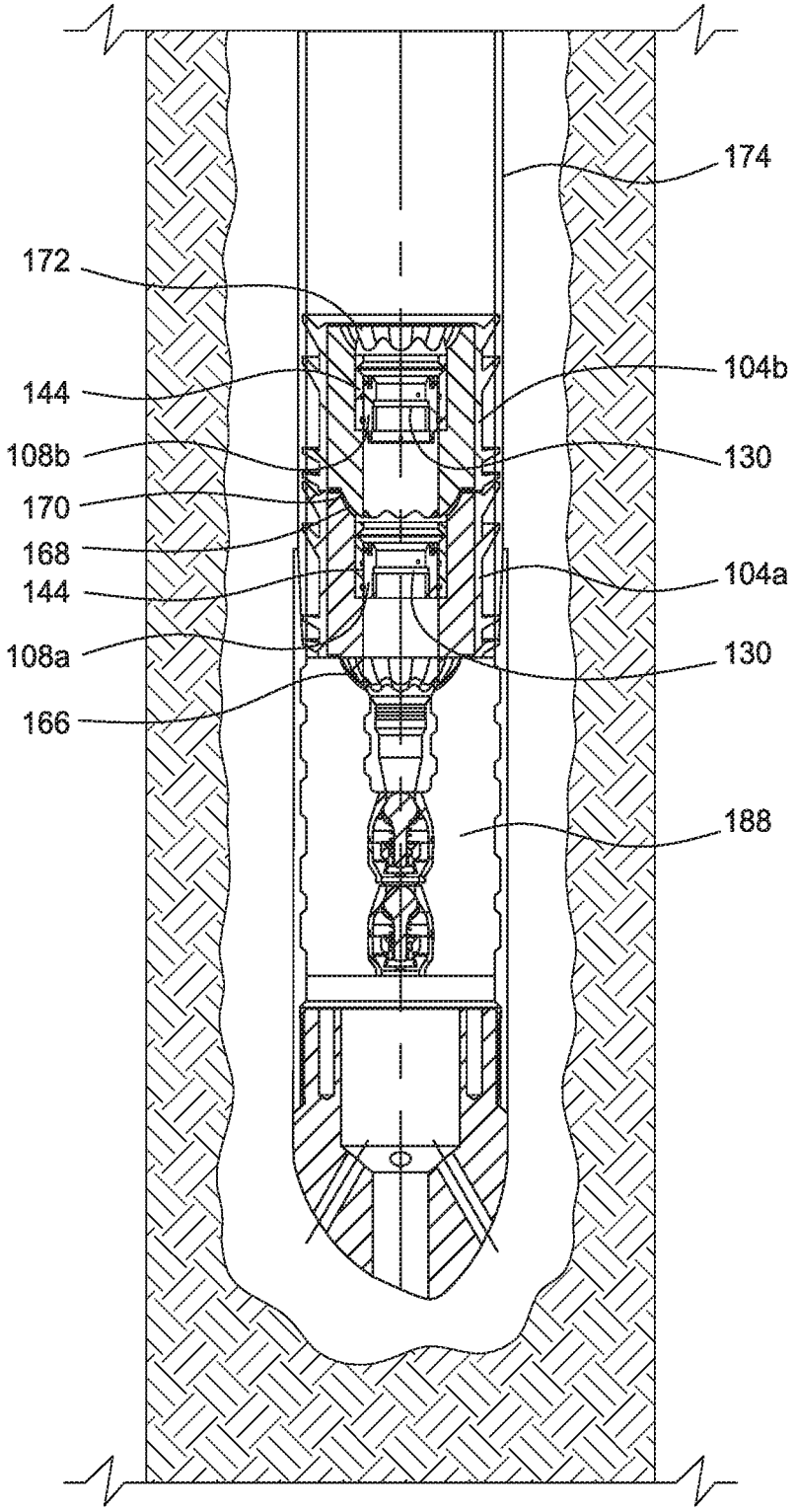
FIG. 15 illustrates a cross-sectional view of the casing string, with the middle plug and the middle detachable insert having been sheared from the plug mandrel body and being landed on the lower plug.
Figure 16:
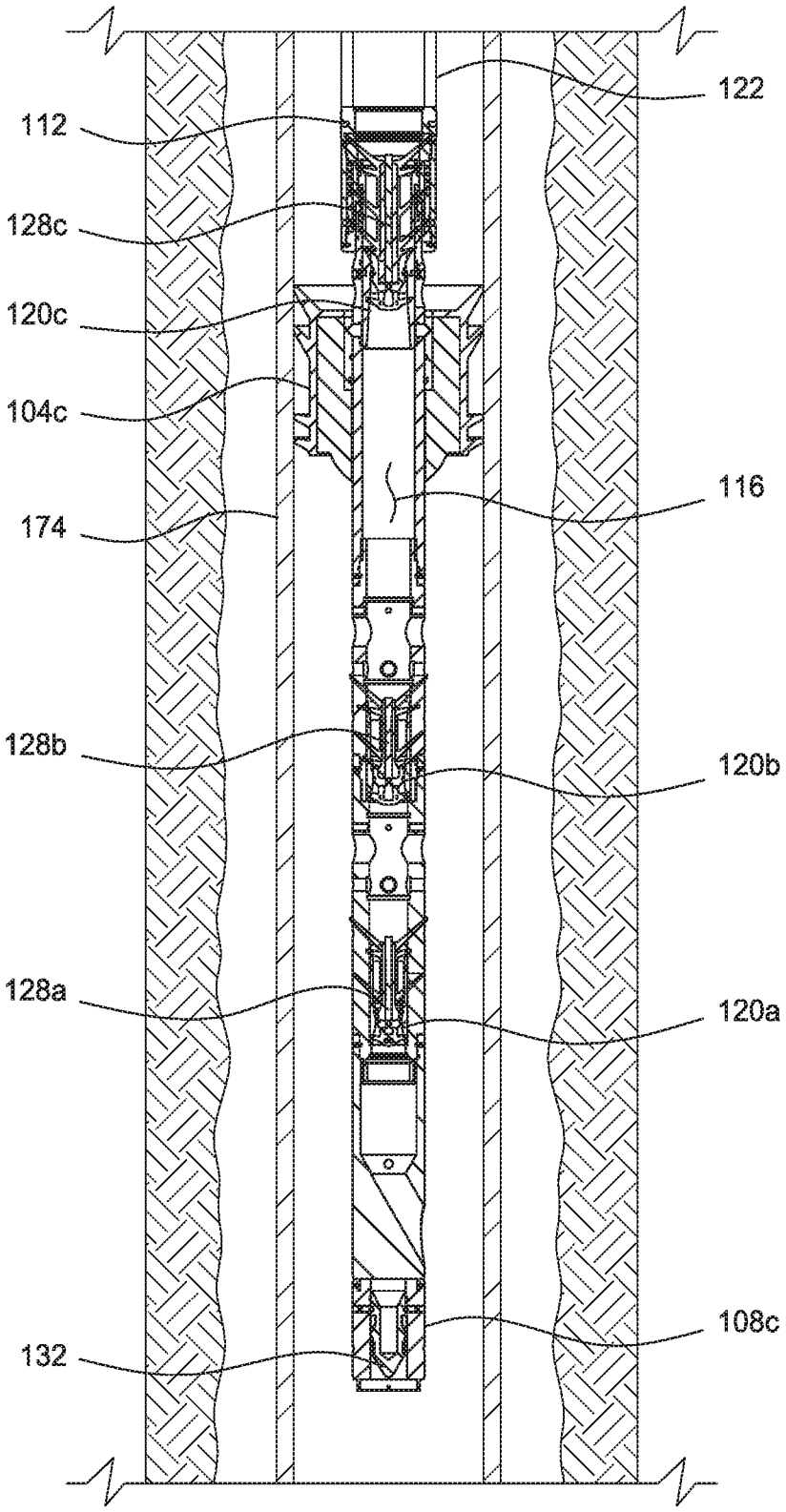
FIG. 16 illustrates a cross-sectional view of the SSR plug system, with a third release member having been received within an upper sleeve of the plug mandrel subassembly.
Figure 17:
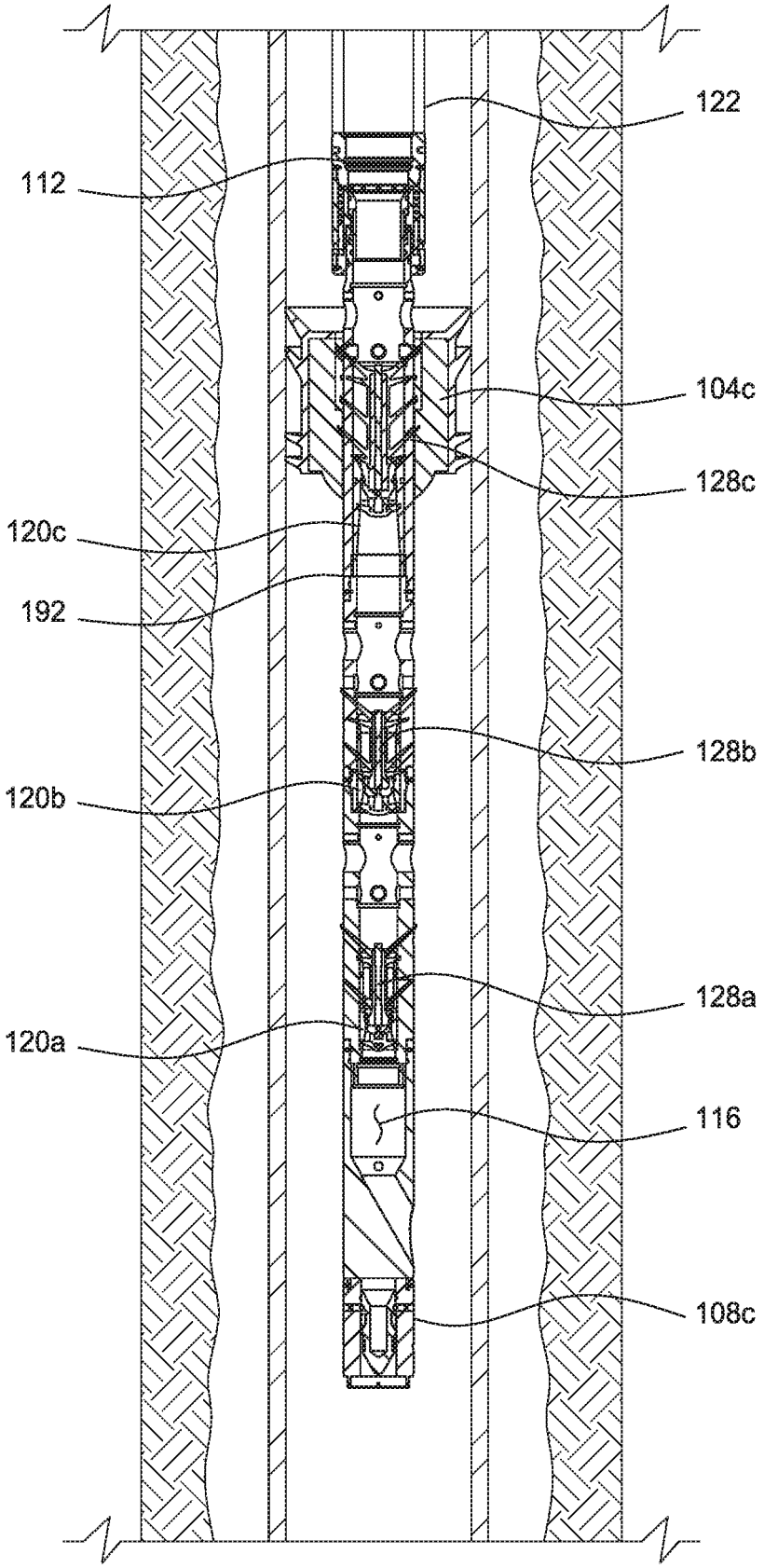
FIG. 17 illustrates a cross-sectional view of the SSR plug system, with the upper sleeve being in the second position to thereby allow fluid flow through an upper flow port pair.
Figure 18:
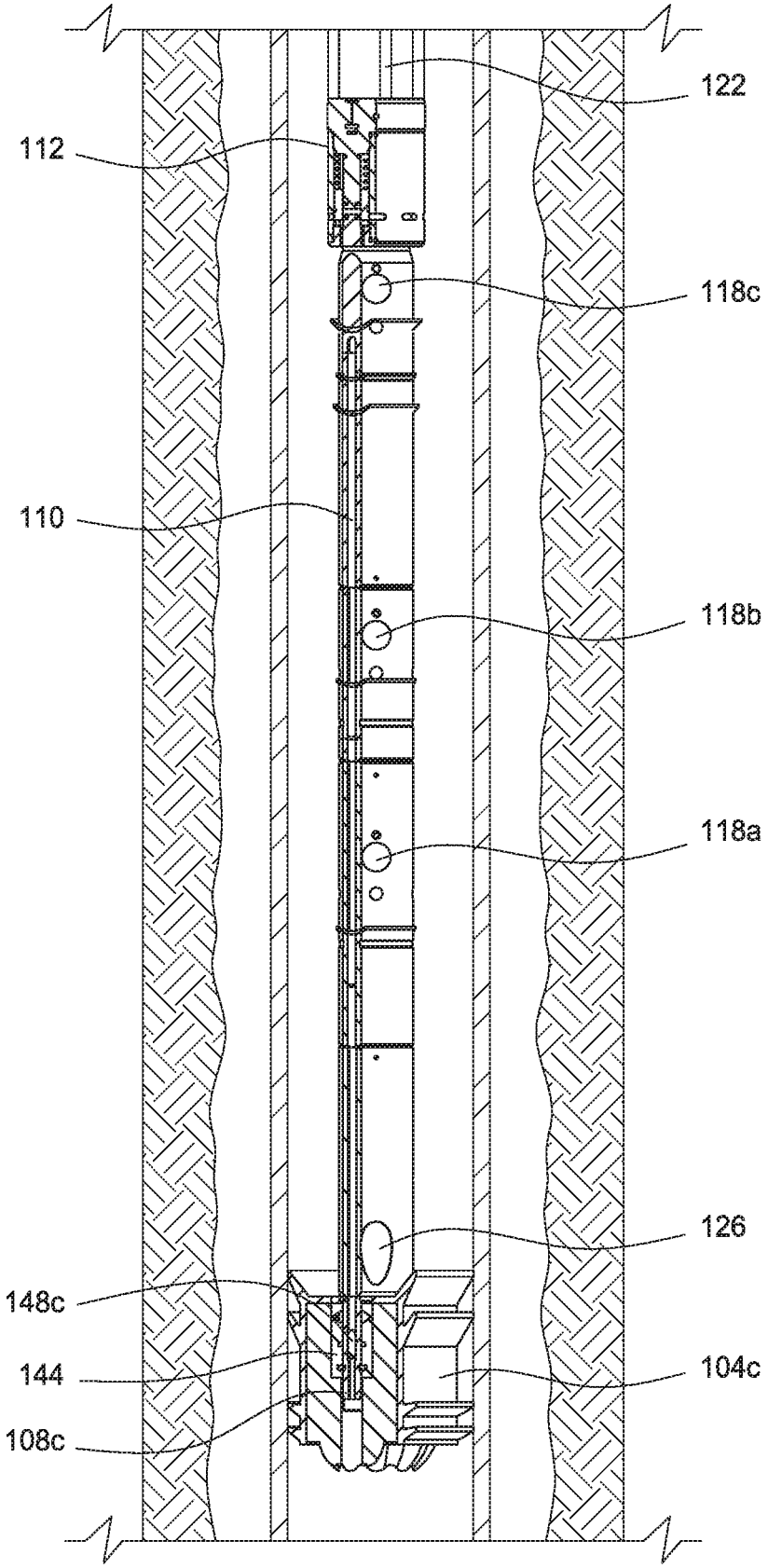
FIG. 18 illustrates a rotated cross-sectional view of the SSR plug system, with the upper plug having been displaced downwardly along the plug mandrel body and being connected to the upper detachable insert.
Figure 19:
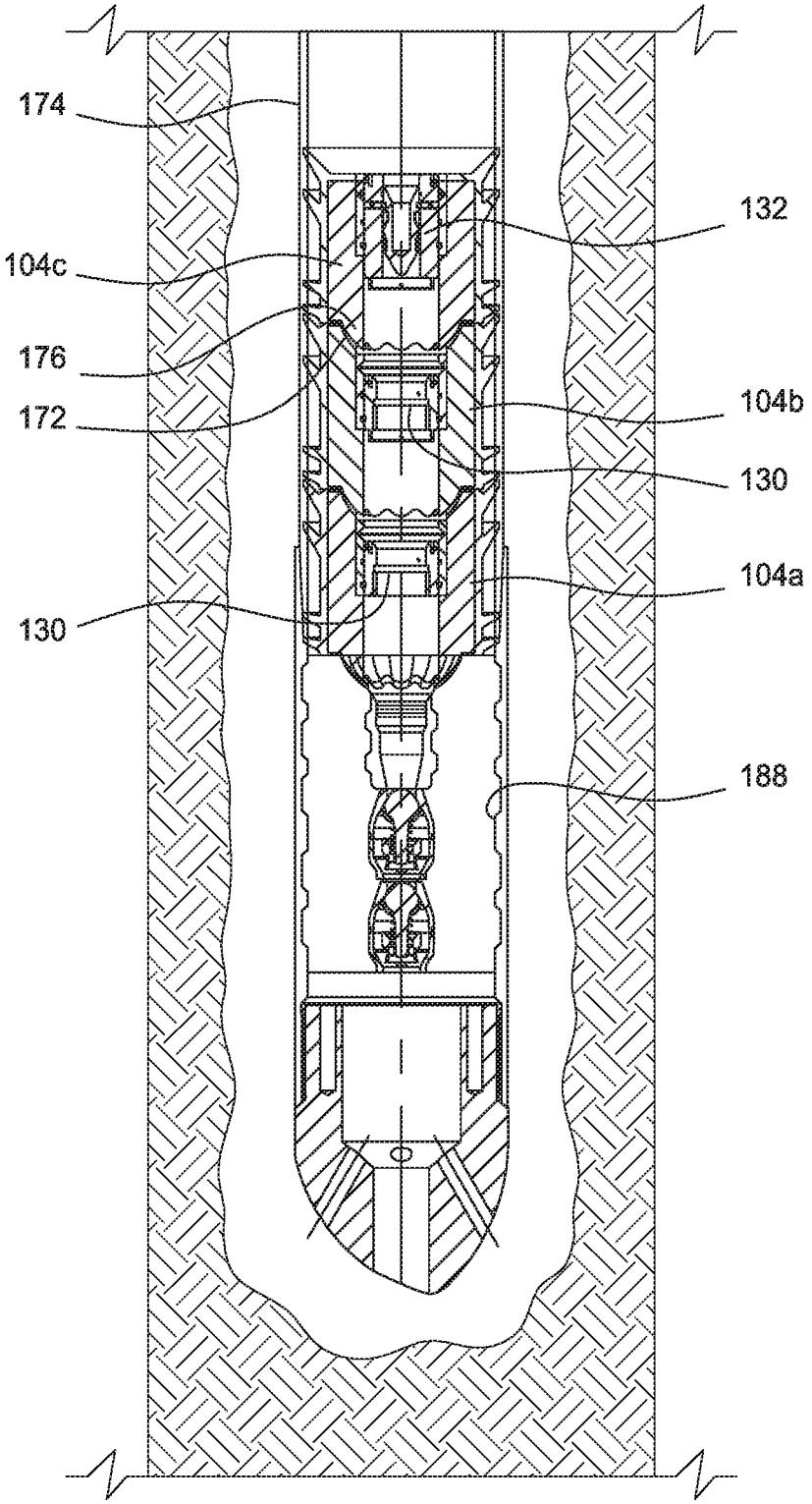
FIG. 19 illustrates a cross-sectional view of the casing string, with the upper plug and the upper detachable insert having been sheared from the plug mandrel body and being landed on the middle plug.

FIG. 7 shows the SSR plug system 100 lowered into the casing string 174, with the top sub 112 being connected to the tubular string 122. The casing string 174 has not yet been cemented in the annulus at this time. FIG. 7 shows the plug mandrel subassembly 102 in a pre-launch position, in which the lower plug 104*a*, the middle plug 104*b*, and the upper plug 104*c* are all releasably attached to the plug mandrel body 106 via the retractable spring components 114. When in the pre-launch position, each of the sleeves 120 of the plug mandrel body 106 are in the first positon in which fluid flow through the corresponding flow port pair 118 is prevented. Accordingly, fluid pumped downstream through the tubular string 122 flows into the inlet port 124, through the bore 116 of the plug mandrel body 106, and exits the outlet port 126.

Figure 20:
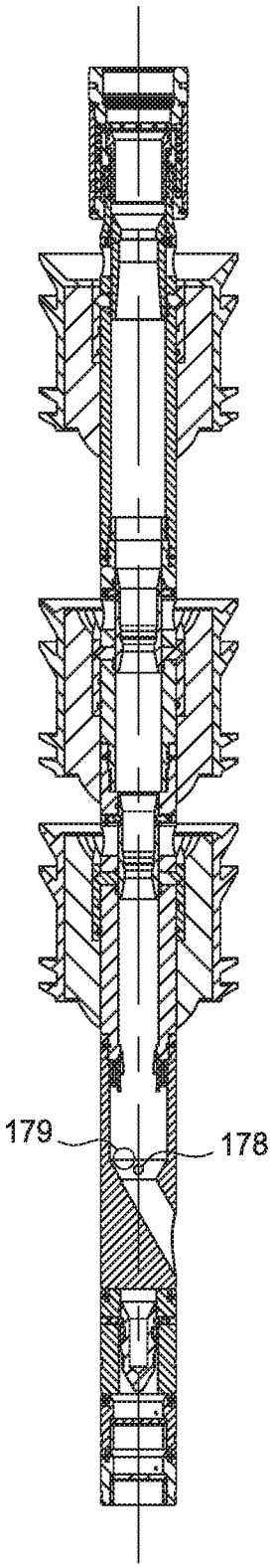
FIG. 20 illustrates a cross-sectional view of an alternative embodiment of a plug mandrel subassembly in accordance with the present disclosure, wherein the plug mandrel bore further includes a ball catcher.

In some embodiments of the SSR plug system 100, the plug mandrel body 106 may further include may further include a ball catcher 178 positioned between the plurality of flow port pairs 118 and outlet port 126, as shown in FIG. 20. The ball catcher 178 is configured to catch a ball 179 flowing downstream within the bore 116 of the plug mandrel body 106. After the ball flowing downstream has been caught by the ball catcher 178, fluid will still be able to flow through the 116 and exit the outlet port 126. In other words, the interaction between the ball catcher 178 and the ball does not create a seal within the bore 116 preventing fluid from continuing to flow through the bore.

Figure 21:
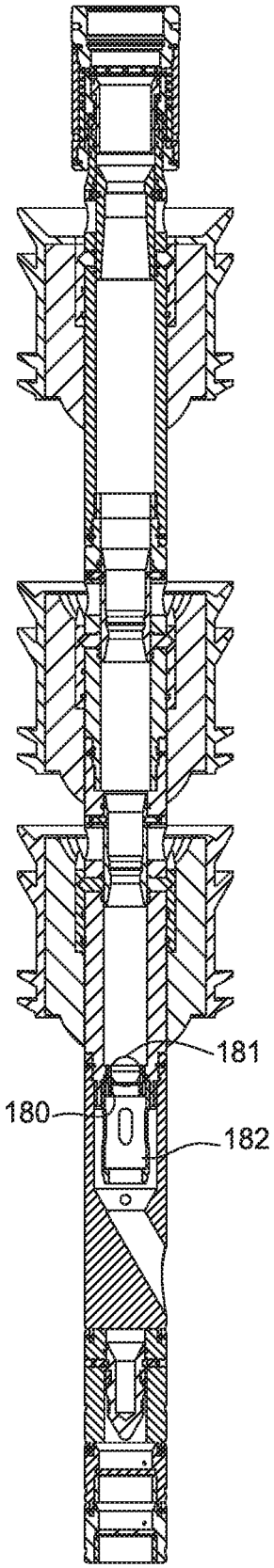
FIG. 21 illustrates a cross-sectional view of another alternative embodiment of a plug mandrel subassembly in accordance with the present disclosure, wherein a plug mandrel bore further includes a ball seat.

In another embodiment of the SSR plug system 100, shown in FIG. 21, the plug mandrel body 106 may further include a ball seat 180 and a bypass valve portion 182. The ball seat 180 is releasably attached to the interior surface of the plug mandrel body 106 defining the bore 116 via a shear pin. The ball seat 180 is positioned between the plurality of flow port pairs 118 and outlet port 126. The ball seat 180 is configured to receive a ball 181 flowing downstream within the bore 116 of the plug mandrel body 106. Upon receipt of the ball, a seal is formed between the ball seat 180 and the ball such that fluid can no longer flow through the bore 116, thereby enabling the hydrostatic pressure within the bore 116 and tubular string 122 to be increased. After the hydrostatic pressure reaches a critical point, the shear pin will shear and ball seat 180 will slide downwardly into the bypass valve portion 182 positioned downstream of the ball seat, thereby restoring the flow of fluid through the bore 166 and out of the outlet port 126. In this manner, the ball seat 180 enables hydrostatic pressure within the tubular string 122 to be increased up to the critical point.

Release of the Lower Plug from the Plug Mandrel Body

As shown in FIGS. 8-11, the lower plug 104*a* is released from the plug mandrel body 106 by pumping first release member 128*a* downstream within the bore 116 of the plug mandrel body 106. As the first release member 128*a* is being pumped downstream within the bore 116, the first release member passes through the upper sleeve 120*c* and the middle sleeve 120*b* before being received by the lower sleeve 120*a*. As discussed above, the first release member 128*a* is a dart and the lower sleeve 120*a* is a dart receiver shearingly attached by a shear pin to the internal surface of the plug mandrel body 106 defining bore 116. After the first release member 128*a* is received within the lower sleeve 120*a*, a seal is formed between the first release member and the lower sleeve thereby preventing fluid flow through the bore 116. Hydrostatic pressure within the bore 116 is then increased until the shear pin connecting the lower sleeve 120*a* to the inner surface of the plug mandrel body 106 shears, shifting the lower sleeve (and the release member received within it) from the first position to the second position. When in the second position, the lower sleeve 120*a* rests on an internal shoulder 184 within the bore 116.

The adjustment of the lower sleeve 120*a* from the first position to the second positon enables fluid to flow through the flow port pair 118*a* adjacent the lower sleeve. As fluid is pumped downstream within the bore 116 of the plug mandrel body 106, fluid passes through the lower flow port pair 118*a*. The fluid passing through the lower flow port pair 118*a* increases the hydrostatic pressure within the casing string 174 upstream of the lower plug 104*a*. The increased hydrostatic pressure results in a downward force being exerted on the lower plug 104*a*, thereby urging the lower plug downstream. As the lower plug 104*a* is urged downstream, the receptacle collar 144 pushes against the angled profile of the retractable spring component 114 to overcome the outward biasing force of the spring component. The retractable spring component 114 is forced inwardly such that the spring component is no longer located within the recessed portion 154 of the receptacle collar 144. Consequently, the lower plug 104*a* is released from the plug mandrel body 106.

The released lower plug 104*a* is displaced downstream along the plug mandrel body 106 by fluid flowing through the lower flow port pair 118*a*, with the protrusion 148*a* of the lower plug traveling within the channel 110. Because the protrusion 148*a* is sized to pass through the channel stop 134 of the upper detachable insert 108*c* and the channel stop 136 of the middle detachable insert 108*b*, the lower plug 104*a* will travel downstream within the channel 110 until reaching channel stop 138 of the lower detachable insert 108*a*. After the protrusion 148*a* reaches the channel stop 138, the lock collar 156 of the lower plug 104*a* expands radially outward within a groove 186 of the lower detachable insert 108*a*. The groove 186 is located immediately below the shoulder 162, such that the shoulder will prevent the lock collar 156 from being displaced from the groove. Collectively, the shoulder 162 and the channel stop 138 connect the lower detachable insert 108*a* to the lower plug 104*a* to thereby prevent the insert from being displaced from the bore 142 of the lower plug.

After the lower detachable insert 108*a* and the lower plug 104*a* are connected, hydrostatic pressure within the casing string 174 will be increased as fluid continues to flow through the lower flow port pair 118*a*. When the hydrostatic pressure within the casing string 174 reaches a critical point, the shear pin releasably connecting the lower detachable insert 108*a* to the middle detachable insert 108*b* will shear, thereby releasing the lower insert 108*a* from the middle insert 108*b*.

The lower plug 104*a* and the lower detachable insert 108*a* are collectively urged downstream within the casing string 174 by the continued flow of fluid through the lower flow port pair 118*a*. The lower plug 104*a* and the lower detachable insert 108*a* are urged downstream until landing on a float assembly 188. An example of a float assembly that may be used in conjunction with the present disclosure is described in detail in U.S. Publication No. 2015/0101801, which is hereby incorporated by reference in its entirety. In U.S. Publication No. 2015/0101801, the float assembly is generally identified by reference numeral 20. After the lower plug 104*a* and the lower detachable insert 108*a* land on the float assembly 188, hydrostatic pressure within the casing string 174 can again be increased until reaching a critical point that will rupture the rupture membrane 130 of the lower detachable insert. Upon reaching the critical point, the rupture membrane 130 of the lower detachable insert will rupture, thereby reestablishing circulation in the well.

Release of the Middle Plug from the Plug Mandrel Body

The next plug to be released from the plug mandrel body 106 is the middle plug 104*b*, as shown in FIGS. 12-15. The middle plug 104*b* is released from the plug mandrel body 106 by pumping a second release member 128*b* downstream within the bore 116 of the plug mandrel body 106. As the second release member 128*b* is being pumped downstream within the bore 116, the release member passes through the upper sleeve 120*c* before being received by the middle sleeve 120*b*. As discussed above, the second release member 128*b* is a dart and the middle sleeve 120*b* is a dart receiver shearingly attached by a shear pin to the internal surface of the plug mandrel body 106 defining bore 116. After the second release member 128*b* is received within the middle sleeve 120*b*, a seal is formed between the second release member and the middle sleeve thereby preventing fluid flow through the bore 116. Hydrostatic pressure within the bore 116 is then increased until the shear pin connecting the middle sleeve 120*b* to the inner surface of the plug mandrel body 106 shears, shifting the middle sleeve (and the release member received within it) from the first position to the second position. When in the second position, the middle sleeve 120*b* rests on an internal shoulder 190 within the bore 116.

The adjustment of the middle sleeve 120*b* from the first position to the second positon enables fluid to flow through the middle flow port pair 118*b* adjacent the middle sleeve. As fluid is pumped downstream within the bore 116 of the plug mandrel body 106, fluid passes through the middle flow port pair 118*b*. The fluid passing through the middle flow port pair 118*b* increases the hydrostatic pressure within the casing string 174 upstream of the middle plug 104*b*. The increased hydrostatic pressure results in a downward force being exerted on the middle plug 104*b*, thereby urging the middle plug downstream. As the middle plug 104*b* is urged downstream, the receptacle collar 144 of the plug pushes against the angled profile 164 of the retractable spring component 114 to overcome the outward biasing force of the spring component. The retractable spring component 114 is forced inwardly such that the spring component is no longer located within the recessed portion 154 of the receptacle collar 144. Consequently, the middle plug 104*b* is released from the plug mandrel body 106.

The released middle plug 104*b* is displaced downstream along the plug mandrel body 106 by fluid flowing through the middle flow port pair 118*b*, with the protrusion 148*b* of the middle plug traveling within the channel 110. Because the protrusion 148*b* is sized to pass through the channel stop 134 of the upper detachable insert 108*c*, the middle plug 104*b* will travel downstream within the channel 110 until reaching channel stop 136 of the middle detachable insert 108*b*. After the protrusion 148*b* reaches the channel stop 136, the lock collar 156 of the middle plug 104*b* expands radially outward within a groove 186 of the middle detachable insert 108*b*. The groove 186 is located immediately below the shoulder 162, such that the shoulder will prevent the lock collar 156 from being displaced from the groove. Collectively, the shoulder 162 and the channel stop 136 connect the middle detachable insert 108*b* to the middle plug 104*b* to thereby prevent the insert from being displaced from the bore 142 of the middle plug.

After the middle detachable insert 108*b* and the middle plug 104*b* are connected, hydrostatic pressure within the casing string 174 will be increased as fluid continues to flow through the middle flow port pair 118*b*. Because the second release member 128*b* remains within the middle sleeve 120*b*, fluid flowing within the bore 116 of the plug mandrel body 106 is unable to flow past the middle sleeve. When the hydrostatic pressure within the casing string 174 reaches a critical point, the shear pin releasably connecting the middle detachable insert 108*b* to the upper detachable insert 108*c* will shear, thereby releasing the middle insert 108*b* from the upper detachable insert 108*c*.

The middle plug 104*b* and the middle insert 108*b* are collectively urged downstream within the casing string 174 by the continued flow of fluid through the middle flow port pair 118*b*. The middle plug 104*b* and the middle detachable insert 108*b* flow downstream until landing on the lower plug 104*a*. The protruding end 170 of the middle plug 104*b* is received within the recessed 168 of the lower plug 104*a*, such that the middle plug 104*b* and the lower plug 104*a* mate with each other. After the middle plug 104*b* and the middle detachable insert 108*a* land on the lower plug 104*a*, hydrostatic pressure within the casing string 174 can again be increased until reaching a critical point that will rupture the rupture membrane 130 of the middle detachable insert. Upon reaching the critical point, the rupture membrane 130 of the lower detachable insert will rupture, thereby reestablishing circulation in the well.

Release of the Upper Plug from the Plug Mandrel Body

The last plug to be released from the plug mandrel body 106 is the upper plug 104*c*, as shown in FIGS. 16-19. The upper plug 104*c* is released from the plug mandrel body 106 by pumping a third release member 128*c* downstream within the bore 116 of the plug mandrel body 106. As the third release member 128*c* is being pumped downstream within the bore 116, the release member will be received by the upper sleeve 120*c*. As discussed above, the third release member 128*c* is a dart and the upper sleeve 120*c* is a dart receiver shearingly attached by a shear pin to the internal surface of the plug mandrel body 106 defining bore 116. After the third release member 128*c* is received within the upper sleeve 120*c*, a seal is formed between the third release member and the upper sleeve thereby preventing fluid flow through the bore 116. Hydrostatic pressure within the bore 116 is then increased until the shear pin connecting the upper sleeve 120*c* to the inner surface of the plug mandrel body 106 shears, shifting the upper sleeve (and the release member received within it) from the first position to the second position. When in the second position, the upper sleeve 120*c* rests on an internal shoulder 192 within the bore 116.

The adjustment of the upper sleeve 120*c* from the first position to the second positon enables fluid to flow through the upper flow port pair 118*c* adjacent the upper sleeve. As fluid is pumped downstream within the bore 116 of the plug mandrel body 106, fluid passes through the upper flow port pair 118*c*. The fluid passing through the upper flow port pair 118*c* increases the hydrostatic pressure within the casing string 174 upstream of the upper plug 104*c*. The increased hydrostatic pressure results in a downward force being exerted on the upper plug 104*c*, thereby urging the upper plug downstream. As the upper plug 104*c* is urged downstream, the receptacle collar 144 pushes against the angled profile of the retractable spring component 114 to overcome the outward biasing force of the spring component. The retractable spring component 114 is forced inwardly such that the spring component is no longer located within the recessed portion 154 of the receptacle collar 144. Consequently, the upper plug 104*c* is released from the plug mandrel body 106.

The released upper plug 104*c* is displaced downstream along the plug mandrel body 106 by fluid flowing through the upper flow port pair 118*c*, with the protrusion 148*c* of the upper plug traveling within the channel 110. The upper plug 104*c* will travel downstream within the channel 110 until reaching channel stop 134 of the upper detachable insert 108*c*. After the protrusion 148*c* reaches the channel stop 134, the lock collar 156 of the upper plug 104*c* expands radially outward within a groove 186 of the upper detachable insert 108*c*. The groove 186 is located immediately below the shoulder 162, such that the shoulder will prevent the lock collar 156 from being displaced from the groove. Collectively, the shoulder 162 and the channel stop 134 connect the upper detachable insert 108*c* to the upper plug 104*c* to thereby prevent the insert from being displaced from the bore 142 of the upper plug.

After the upper detachable insert 108*c* and the upper plug 104*c* are connected, hydrostatic pressure within the casing string 174 will be increased as fluid continues to flow through the upper flow port pair 118*c*. Because the third release member 128*c* remains within the upper sleeve 120*c*, fluid flowing within the bore 116 of the plug mandrel body 106 is unable to flow past the upper sleeve. When the hydrostatic pressure within the casing string 174 reaches a critical point, the shear pin releasably connecting the upper detachable insert 108*c* to the plug mandrel body 106 will shear, thereby releasing the upper insert 108*c* from the plug mandrel body 106.

The upper plug 104*c* and the upper detachable insert 108*c* are collectively urged downstream within the casing string 174 by the continued flow of fluid through the upper flow port pair 118*c*. The upper plug 104*c* and the upper detachable insert 108*c* flow downstream until landing on the middle plug 104*b*. The protruding end 176 of the upper plug 104*c* is received within the recessed end 172 of the middle plug 104*b*, such that the upper plug 104*c* and the middle plug 104*b* mate with each other, thereby connecting all three plugs. After the upper plug 104*c* and the upper detachable insert 108*c* land on the middle plug 104*b*, hydrostatic pressure within the casing string 174 can be increased to shear the sealing member 132 from the upper detachable insert 108*c*. As discussed in detail in U.S. Pub. No. 2015/0101801, sealing member 132 has a conical section to facilitate movement through the middle and lower plugs previously pumped downstream.

Removal of the Plug Mandrel Body

After the lower plug 104*a*, the middle plug 104*b*, and the upper plug 104*c* have each been individually and sequentially released from the plug mandrel body 106 of the SSR plug system 100, the plug mandrel body may be removed from the casing string 174. Because of the design of the SSR plug system 100, removal of the plug mandrel body enables the first release member 128*a*, the second release member 128*b*, and the third release member 128*c* to be retrieved. In other words, the first release member 128*a*, the second release member 128*b*, and the third release member 128*c* remain within the plug mandrel body 106 after the release of the plugs 104. Because the release members 128 remain within the plug mandrel body 106 after the release of the plugs 104, the release members are retrieved when the plug mandrel body is retrieved. The ability to retrieve the release members 128 enables the release members to be used multiple times in different wells. Accordingly, more technology and money can be invested within the release members 128.

While the foregoing is directed to embodiments of the present disclosure, other and further embodiments may be devised without departing from the basic scope thereof, and the scope thereof is determined by the claims that follow. For example, a person of ordinary skill in the art will understand that the various embodiments of the SSR plug system described within the present disclosure could be altered to include more or less than the number of plugs described herein. Additionally, a person of ordinary skill in the art will understand that additional types of detachable inserts can be used in accordance with the present disclosure. For example, the detachable insert may be include a nozzle to enable a controlled flow of fluid through a central opening of the detachable insert. Additionally, the terms "upstream" and "downstream" are used to describe the location or direction of movement a component within a well relative to the sea floor. For example, a downstream component is located further within the well (i.e., spaced from the sea floor) than an upstream component. While the foregoing description is directed to embodiments of the present disclosure, other and further embodiments may be devised without departing from the basic scope thereof.

The invention claimed is:

1. A plug, comprising:

a plug body including a body bore; and a collar located within the body bore, the collar including:

a collar bore, the collar bore including a circumference; and a protrusion extending radially into the collar bore, the protrusion including a width that is less than the circumference, and wherein the protrusion is configured to extend into a longitudinal channel of an insert when the insert is at least partially disposed in the body bore.

2. The plug of claim 1, wherein the collar further includes a lock collar.

3. The plug of claim 1, wherein the collar includes a seal disposed in a seal channel, wherein the seal is configured to seal against the insert when the insert is at least partially disposed in the body bore.

4. The plug of claim 3, wherein the seal channel is a c-shaped channel including a first end and a second end, the first end spaced from the second end by the protrusion.

5. The plug of claim 1, wherein the plug has a protruding end and a recessed end, the recessed end including an inverted profile matching the protruding end.

6. The plug of claim 1, wherein the collar includes a recessed portion, wherein the plug is configured to be releasably connected to a plug mandrel body via a retractable spring component engaged with the recessed portion.

7. A plug mandrel subassembly comprising:

a plug mandrel body including an interior surface and an exterior surface, the plug mandrel body further including:

a bore defined by the interior surface;

a flow port fluidly connected to the bore;

an adjustable sleeve positionable to prevent fluid from flowing through the flow port; and a first portion of a channel disposed on the exterior surface; and an insert releasably connected to the plug mandrel body and including a second portion of the channel.

8. The plug mandrel subassembly of claim 7, wherein the adjustable sleeve includes a dart receiver attached to the interior surface of the plug mandrel body defining the bore.

9. The plug mandrel subassembly of claim 8, wherein the dart receiver is attached to the interior surface by at least one shear pin.

10. The plug mandrel subassembly of claim 8, wherein the dart receiver is positionable between a first position and a second position, the dart receiver preventing fluid flow through the flow port when in the first position and allowing fluid flow through the flow port when in the second position.

11. The plug mandrel subassembly of claim 7, wherein the insert is releasably connected to the plug mandrel body using at least one shear pin.

12. The plug mandrel subassembly of claim 7, wherein the insert is a first detachable insert, the plug mandrel subassembly further comprising and a second detachable insert with a third portion of the channel, the first detachable insert releasably connected to the plug mandrel body using a first shear pin and the second detachable insert releasably connected to the first detachable insert using a second shear pin.

13. The plug mandrel subassembly of claim 7, wherein the insert further comprises a channel stop configured to receive a protrusion of a plug positioned about the plug mandrel body.

14. The plug mandrel subassembly of claim 7, further comprising a plug positioned about the plug mandrel body and movable from a first position to a second position, wherein the plug is spaced apart from the insert in the first position, and wherein the plug is in contact with the insert when the plug is in the second position.

15. The plug mandrel subassembly of claim 7, wherein the plug mandrel body further includes a retractable spring component, the retractable spring component biased radially outward from the plug mandrel body.

16. The plug mandrel subassembly of claim 15, wherein the retractable spring component includes an angled profile configured to move the retractable spring component radially inward in response to a shearing force.

17. The plug mandrel subassembly of claim 7, wherein the plug mandrel body further includes a ball catcher, the ball catcher configured to a catch a ball flowing downstream within the bore while enabling fluid to continue to flow through the bore.

18. The plug mandrel subassembly of claim 7, wherein the plug mandrel body further includes a ball seat, the ball seat releasably attached to the interior surface of the plug mandrel body defining the bore, the ball seat configured to receive a ball flowing downstream within the bore to block fluid flow through the bore.

19. The plug mandrel subassembly of claim 18, wherein the ball seat is releasably attached to the interior surface by at least one shear pin and the plug mandrel body further includes a bypass valve portion downstream of the ball seat, the bypass valve portion configured to receive the ball seat after the ball seat has been released from the interior surface, wherein fluid flow through the bore is unblocked when the ball seat is received in the bypass valve portion.

20. A method of operating a subsurface release plug system, comprising:

releasing a first plug from a plug mandrel body including a first longitudinal channel, wherein the first plug includes a first protrusion disposed in the first longitudinal channel;

displacing the first plug relative to the plug mandrel body, wherein the first protrusion travels within the first longitudinal channel; and connecting the first plug with a first insert releasably coupled to the plug mandrel body, wherein the first protrusion is disposed in a second longitudinal channel of the first insert.

21. The method of claim 20, further comprising decoupling the first insert from the plug mandrel body.

22. The method of claim 21, further comprising:

releasing a second plug from the plug mandrel body, wherein the second plug includes a second protrusion disposed in the first longitudinal channel;

displacing the second plug relative to the plug mandrel body, wherein the second protrusion travels within the first longitudinal channel;

connecting the second plug with a second insert releasably coupled to the plug mandrel body, wherein the second protrusion is disposed in a third longitudinal channel of the second insert; and decoupling the second insert from the plug mandrel body.

23. The method of claim 22, further comprising:

releasing a third plug from the plug mandrel body, wherein the third plug includes a third protrusion disposed in the first longitudinal channel;

displacing the third plug relative to the plug mandrel body, wherein the third protrusion travels within the first longitudinal channel;

connecting the third plug with a third insert releasably coupled to the plug mandrel body, wherein the third protrusion is disposed in a fourth longitudinal channel of the third insert; and decoupling the third insert from the plug mandrel body.

24. The method of claim 21, further comprising:

landing the first plug on a float assembly;

rupturing a rupture membrane of the first insert.

25. The method of claim 20, wherein prior to connecting the first plug with the first insert, the first plug travels past a second insert including a third longitudinal channel and a third insert including a fourth longitudinal channel, wherein the first protrusion slides within the third and fourth longitudinal channels.

* * * * *